US007175395B1

(12) United States Patent
Forest

(10) Patent No.: US 7,175,395 B1
(45) Date of Patent: Feb. 13, 2007

(54) PRESSURE ENHANCER VALUE SYSTEM

(76) Inventor: Daniel L. Forest, 3091 Cayou Quay, P.O. Box 55, Deer, WA (US) 98243

( * ) Notice: Subject to any disclaimer, the term of this patent is extended or adjusted under 35 U.S.C. 154(b) by 146 days.

(21) Appl. No.: 10/455,604

(22) Filed: Jun. 4, 2003

Related U.S. Application Data

(60) Provisional application No. 60/386,458, filed on Jun. 4, 2002.

(51) Int. Cl.
*F04B 17/00* (2006.01)

(52) U.S. Cl. ..... 417/225; 417/226; 417/393; 417/401; 417/534

(58) Field of Classification Search ..... 417/225, 417/226, 393, 401, 534
See application file for complete search history.

(56) References Cited

U.S. PATENT DOCUMENTS 4,386,888 A * 6/1983 Verley ..... 417/393
4,515,516 A * 5/1985 Perrine et al. ..... 417/38
4,627,794 A * 12/1986 Silva ..... 417/225
4,674,958 A * 6/1987 Igarashi et al. ..... 417/225
4,927,335 A * 5/1990 Pensa ..... 417/393
5,462,414 A * 10/1995 Permar ..... 417/313

* cited by examiner

*Primary Examiner*—Anthony D. Stashick
*Assistant Examiner*—Ryan P. Gillan
(74) *Attorney, Agent, or Firm*—Robert B. Hughes; Hughes Law Firm, PLLC

(57) ABSTRACT

A system to intensify pressure supplied by a conventional pump where a piston assembly having two piston members at opposite ends is positioned in a pressure cylinder. The laterally outer subchambers are defined by the piston members and the cylinder and are adapted to receive fluid at an operating pressure provided by the pump and produce intensified pressure at the opposite outer subchamber. A pressure distributing system alternates returning fluid at intensified pressure to the inner subchamber near the outer subchamber creating the intensified pressure.

8 Claims, 19 Drawing Sheets

PRESSURE ENHANCER VALUE SYSTEM

RELATED APPLICATIONS

This application claims priority benefit of Provisional U.S. Ser. No. 60/386,458, filed Jun. 4, 2002.

FIELD OF THE INVENTION

The present invention relates to apparatus for creating pressurized fluid at an intensified pressure by using a conventional pumping device providing a lower operating pressure. One application of the intensified pressure is used in a reverse osmosis filter for purification of seawater.

DESCRIPTION OF THE EMBODIMENTS

Figure 1:
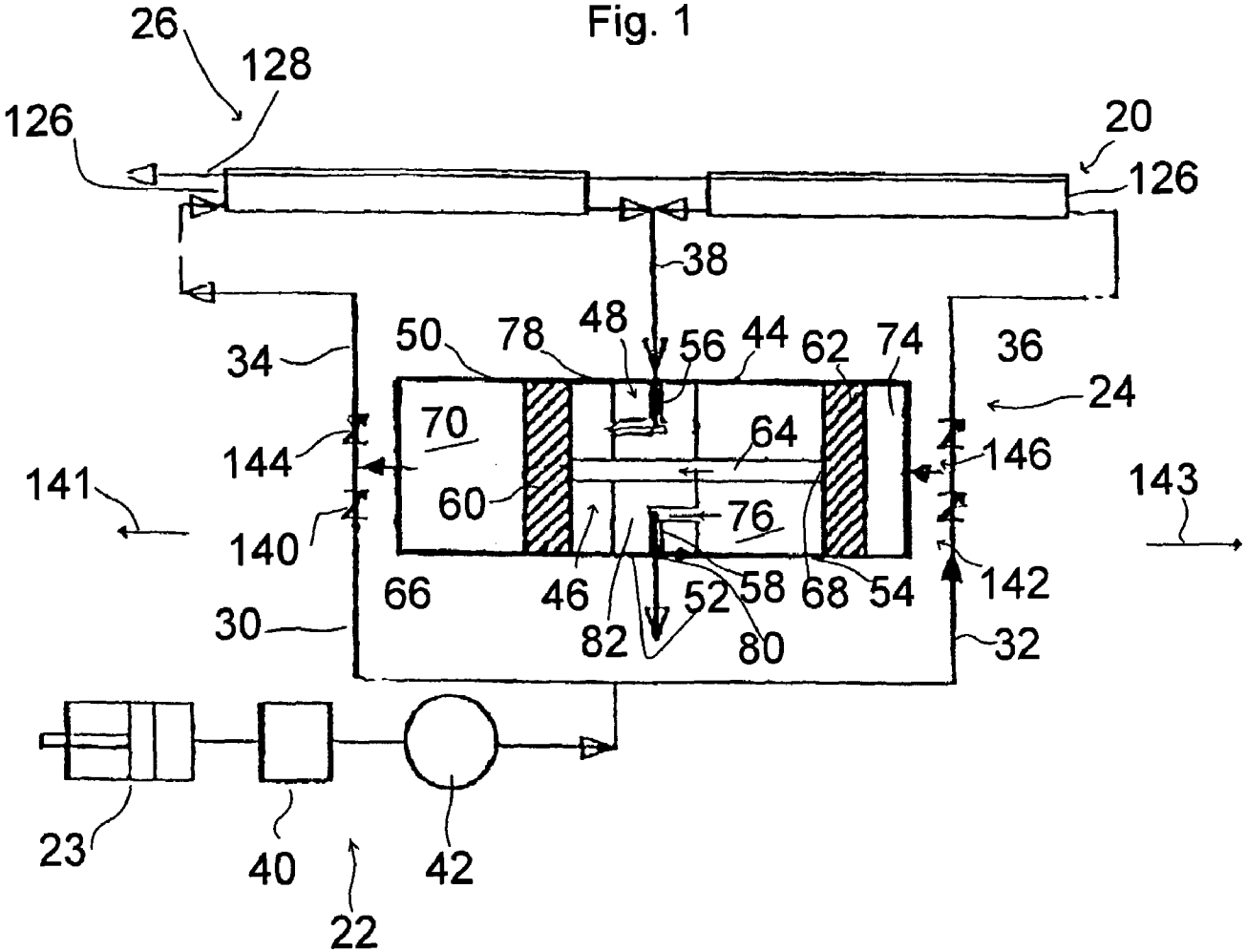
FIG. 1 schematically shows the pressure intensifier system in a first position where the return operating fluid under intensified pressure is in communication with the first laterally inner subchamber.

The invention relates to a pressure intensifier system adapted to increase the pressure of an operating fluid. The pressure intensifier comprises a pressure cylinder, a piston assembly, a pressure distributor system, a fluid distributor system and a high pressure receiving section.

The pressure cylinder has a first region, a central region and a second region. The pressure distributor system is located in the central region to separate the first and second regions from one another. The lateral direction from the central region to the first region indicates a first direction and the opposing lateral direction from the central region to the second region indicates a second direction. The pressure cylinder has an interior surface, a high pressure passage, and an exit passage.

The piston assembly comprises a first piston member positioned in the first region of the pressure cylinder. The first piston member is in sealing engagement with the inner wall of the pressure cylinder thereby defining a first laterally outer subchamber and a first laterally inner subchamber. A second piston member is positioned in the second region of the pressure cylinder in sealing engagement with the inner wall of the pressure cylinder, thereby defining a second laterally outer subchamber and a second laterally inner subchamber. The piston assembly has a connecting rod having first and second lateral ends that are each fixedly having first and second lateral ends that are each fixedly connected to the first and second piston members respectively.

The fluid distributor system directs lower pressure fluid alternately to the first and second laterally outward subchambers, and receives higher pressure fluid alternately from said second and first laterally outer subchambers and delivers higher pressure fluid.

The high pressure receiving section comprises a high pressure inlet portion to receive the higher pressure fluid and direct a first portion of the higher pressure fluid to the high pressure passage of the pressure cylinder, and direct a second portion of the higher pressure fluid to a second location.

In one embodiment, the pressure distributor system comprises a first valve which is located in the central region of the pressure cylinder and enables communication alternately between the high pressure passage and either the first laterally inner subchamber or the second laterally inner subchamber. The first valve has a first biasing member that biases the first valve to a second position that provides communication between the second laterally inner subchamber and the high pressure passage. The first valve also has a second biasing member adapted to change the first valve to a first position that provides communication between the first laterally inner subchamber and the high pressure passage.

The pressure distributor system also has a second valve that is located in the central region of the pressure cylinder and enables communication between an exit passage and either the first laterally inner subchamber or the second laterally inner subchamber. The second valve has a first biasing member that biases the first valve to a first position that provides communication between the second laterally inner subchamber and the exit passage, and a second biasing member adapted to change the second valve to a second position that provides communication between the first laterally inner subchamber and the exit passage.

The system has a pressurizing system having a first line that is in communication with the first laterally outer subchamber and the second laterally outer subchamber along with a check valve system allows unidirectional flow to the first or second laterally outer subchambers.

The high pressure receiving section has a high pressure inlet port connected to the first and second laterally outer subchambers, along with a check valve system allows unidirectional flow to the inlet port. A return line provides communication to the high pressure inlet port and the high pressure passage of the pressure cylinder. The high pressure receiving member has a high pressure operating device (e.g. a reverse osmosis filter) in communication with the high pressure inlet port.

The piston assembly is adapted to oscillate to alternately displace operating fluid contained in the first laterally outer subchamber and the second laterally outer subchamber to deliver a portion of the pressurized fluid to the high pressure receiving member and another portion of this fluid to the high pressure passage of the pressure cylinder.

The biasing members function in a manner to prevent a stall position where the piston assembly is not able to move in the first or second direction.

A first embodiment is disclosed in FIG. 1 where the pressure intensifier system 20 comprises generally a pressurizing system 22 having a pump 23, a pressure intensifier, hereinafter referred to as a pressure multiplier 24, and high pressure receiving section 26. Generally speaking, the pressurizing system 22 provides an input pressure that in one form is produced by a conventional incompressible fluid pump.

The pressure multiplier 24 comprises a pressure cylinder 44 in which is a piston assembly 46 that has a dual piston arrangement with a feedback route through a pressure distributor system 48 to inner chambers to provide a balancing pressure acting in the inner surface wall of the pressure output piston in the direction of piston travel to assist in the increase of pressure. The high pressure receiving member 26 is adapted to receive the intensified pressure fluid from the pressure multiplier 24 and use the intensified pressure for a desired operation. One use for the intensified pressure is with a reverse osmosis membrane used for the purification of seawater.

The high pressure receiving member 26 has a return passage 38 that provides the intensified pressurized fluid to the pressure distributor system 48 of the pressure multiplier 24, which distributes the pressure intensified fluid to the active laterally inner chamber to assist in the piston movement. The above method for intensifying pressure is further described later herein more specifically with reference numerals to designate specific components and assemblies. Although the disclosed embodiment shows a method of intensifying pressure for one particular use, equivalent assemblies that serve the same or a similar function can be substituted without departing from the scope of the invention as defined in the claims.

The major assemblies, the pressurizing system 22, the pressure multiplier 24 and the high pressure receiving member 26 direct the operating fluid through various fluid conduits or fluid lines. The lines 30 and 32 allow the operating fluid to pass from the pressurizing system 22 to the pressure multiplier 24. Further, the output lines 34 and 36 provide hydraulic communication between the laterally outward pressure subchambers (to be described later herein) of the pressure multiplier 24 and the high pressure receiving member 26. These various lines along with their associated check valves are generally designated the "fluid distributor system 35". The return line 38 allows a return path of the fluid that is under intensified pressure back to the pressure distributor system 48 of the pressure multiplier 24. The communication lines can be constructed of any conventional manner. These lines 30–36 allow the operating fluid to flow between the various assemblies and preferably with minimal flow resistance to reduce unnecessary fluid head loss. Also, it should be understood that the pressure distributor system is shown only schematically in FIG. 1, to show a flow pattern in one part of an operating cycle.

The pressurizing system 22 comprises the aforementioned pump 23 and in the preferred form includes a pre-filter 40 and an accumulator 42. The pressurized fluid may be supplied by a conventional electric pump or hand pump, preferably a positive displacement pump such as a piston pump to create sufficiently high pressures; however, other forms of pumps could be employed. The ranges of operating pressures may be 20–200 pounds per square inch. The pre-filter 40 is employed to filter out small particulate matter (e.g. >5 microns) and the accumulator 42 is employed to store the fluid at the operating pressure to be supplied through lines 30 and 32. These components schematically shown in FIG. 1 can be integrated into a singe device for purposes of portability.

The pressure multiplier 24 comprises the aforementioned pressure cylinder 44, the piston assembly 46 and the pressure distributor system 48. The pressure cylinder 44 is adapted to withstand the internal pressures produced by the system, which can be up to 900 psi and higher. The pressure cylinder 44 has an inner wall surface that is in a sealing engagement with the pistons 60 and 62. The pressure cylinder 44 has a longitudinal axis extending along its lengthwise region and it further has a first end region 50, a central region 52 and a second end region 54. The regions are arranged to house the aforementioned main components. Specifically, the first piston member 60 is located in the first region 50, the pressure distributor system 48 is located in the central region 52 and the second piston member 62 is located in the second region 54. The pressure distributor system 48 is stationary in the central region 52 into first and second sub-regions on opposite sides of the pressure distributor system 48.

The cylinder further has a high pressure passage 56 and an exit passage 58, both of which are adapted to communicate with the pressure distributor system 48 discussed in further detail later herein. The pressure cylinder is preferably cylindrical in shape; however, any cross-sectional shape that permits the oscillatory motion of the piston assembly 46 and can withstand the intensified pressure is suitable for operation.

As indicated above, the piston assembly 46 comprises a first piston member 60 and a second piston member 62, and the two pistons 60 and 62 are connected by a connecting rod 64 (also referred to as a central shaft). The central shaft 64 has a diameter d and is preferably cylindrical in shape. The cross-sectional area of the shaft 64 is constant to allow passage through a central opening of the pressure distributor system 48. The central shaft 64 has a first end portion 66 and a second end portion 68. The first piston member 60 is attached to the first end portion 66 of the central shaft 64. The first piston member 60 in conjunction with the first region 50 of the pressure cylinder 44 defines two subchambers, a first laterally outer subchamber 70 and a first laterally inner subchamber 72, defined by the first piston member 60 and the pressure distributor system 48. In a similar fashion, the second piston member 62 in conjunction with the second region 54 of the pressure cylinder 44 defines two subchambers, a second laterally outer subchamber 74 and a second laterally inner subchamber 76 defined by the second cylinder 62 and the pressure distributor system 48. Each of the subchambers is substantially sealed from the adjacent subchamber(s) and to the environment outside of the pressure cylinder 44.

The inner subchambers 72 and 76 communicate with the operating fluid through the pressure distributor system 48 to alternate between ambient pressure and intensified pressure (the process is described in detail following the discussion of the pressure distributor system infra). The pistons 60 and 62 have a diameter "d" and a cross-sectional area. In a preferred form, cross-sectional areas of the pistons 60 and 64 (and corresponding cylinder 44 sections) are the same; however if they are not the same (particularly in cross-sectional area) then the intensified pressure will change with respect to the piston assembly's direction of travel. The ratio of the piston cross-sectional area with respect to the central shaft's 64 cross-sectional area determines the maximum pressure multiple of the system. The maximum pressure multiple is the piston cross-sectional area divided by the central shaft's 64 cross-sectional area and this number is multiplied by the operating pressure to give a number that is slightly higher than the maximum possible theoretical pressure output of the pressure intensifier system 20. Further, the cross-sectional area of the central shaft 64 multiplied by the distance the shaft is displaced longitudinally, determines the amount of operating fluid ejected from the system through the exit port 128 of the high pressure receiving member 26. This is further described herein following a discussion of the pressure distributor system 48.

The pressure distributor system 48 is responsible for alternating the communication of the intensified pressure between the first and second laterally inner subchambers 72 and 76. The pressure distributor system 48 further alternates the communication of the opposing laterally inner subchamber (the one not exposed to the intensified pressure) to the exit passage 58 of the cylinder to atmospheric pressure. As will become apparent later herein, the pressure distributor system has a set of internal biasing members which operate in a manner that the piston assembly will not be in a stall position at which the piston assembly 46 would remain motionless.

Figure 2:
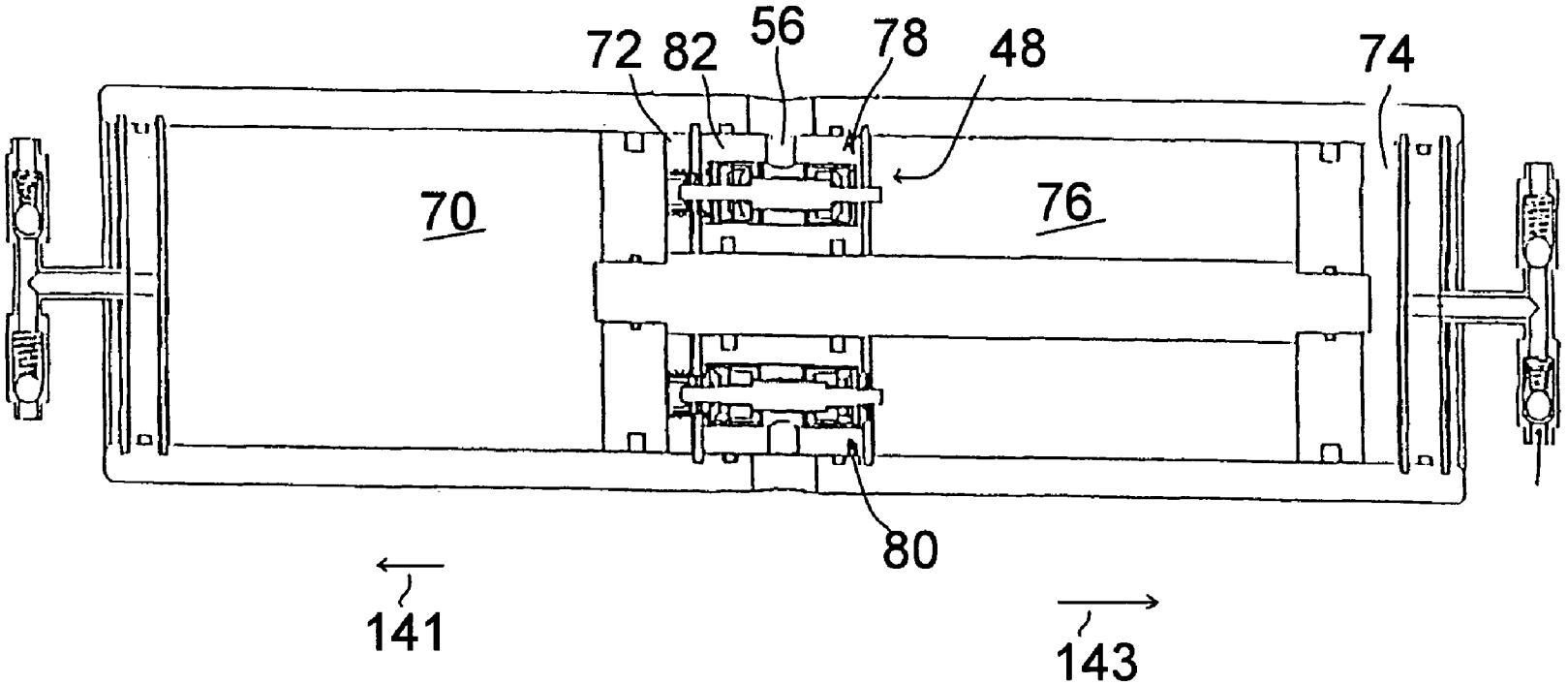
FIG. 2 shows the pressure multiplier where the pressure distributor system is in a first position.
Figure 3:
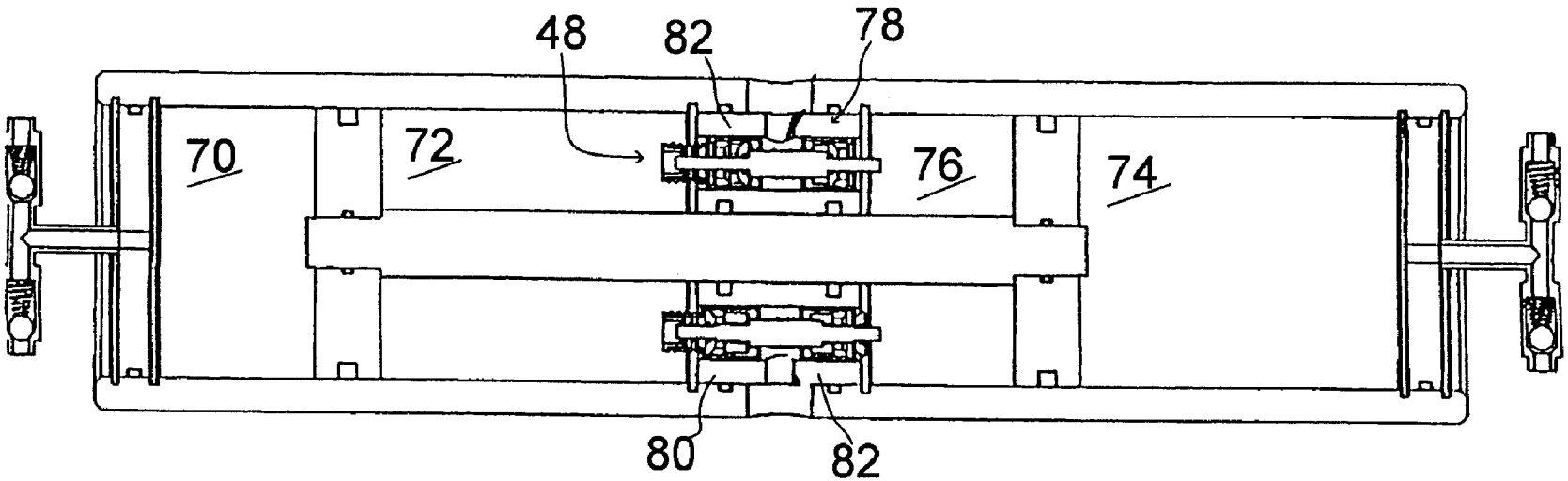
FIG. 3 shows the piston assembly moving in the first direction (to the left) with respect to the position as shown in FIG. 2.

The pressure distributor system 48 comprises a first valve 78, a second valve 80 and a valve housing 82. As shown in FIG. 2 and FIG. 3, the pressure distributor system 48 is in a state where the communication paths have the same basic flow pattern as the ones schematically shown in FIG. 1, except that the flow pattern reverses on every half cycle. The first laterally inner subchamber 72 is in communication with the high pressure passage 56 and the second laterally inner subchamber 76 is in communication with the exit passage 58 of the pressure cylinder 44, and this flow pattern reverses on every half cycle.

Figure 4:
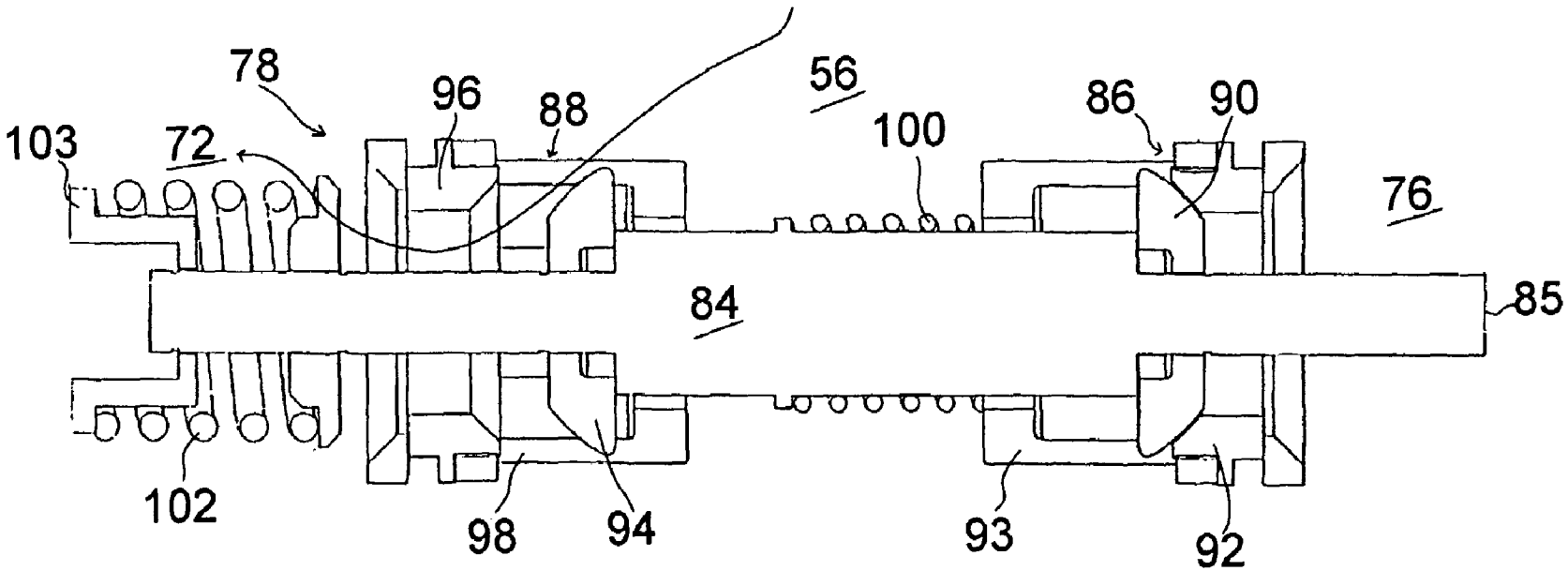
FIG. 4 shows the first valve in a first position where the returning fluid from the high pressure receiving member is in communication with the first laterally inner subchamber.

As shown in FIG. 4, the first valve 78 comprises a central shaft 84, a first valve element 86, and a second valve element 88. The first valve element 86 comprises a first stop member 90 and a first stop seat 92. The first stop member 90 is attached to the central shaft 84 and is adapted to engage the stop seat 92 to provide a seal between the second laterally inner subchamber 76 and the high pressure passage 56. The first stop seat 92 is attached to the valve housing 82 which is in turn attached to the pressure cylinder 44. In the preferred form an encasement 93 is employed to position the central shaft 84 and to provide a base for the first biasing member 100. In a preferred method of assembly, annular retention rings are cut in the valve housing 82 and a retention ring (not shown) is used to hold the encasement 93 in place (and the other encasements are held in a similar manner).

Also shown in FIG. 4, the second valve element 88 is comprised of similar components as the first valve element 86 where a second stop member 94 is attached to the central shaft 84 and the second stop seat 96 is attached to the valve housing 82 (see FIG. 3). The operation of the second valve element is similar to that of the first valve element 86 where if the second stop member 94 is in engagement with the second stop seat 96, the first laterally inner subchamber 72 is not in communication with the high pressure passage 56. An encasement 98 assists in positioning the shaft 84 and supporting the second stop seat 96.

The first valve 78 also comprises a first biasing member 100 and a second biasing member 102. The first biasing member biases the central shaft 84 in the second direction with respect to the pressure cylinder 44. The second biasing member 102 has a first end attached to the central shaft 84 and a second end that is adapted to engage the second piston member 62. The second biasing member 102 will not begin to compress or not substantially compress until the first stop member 90 engages the first stop seat 92. Therefore, the second biasing member 102 has an effectively higher spring constant than the first biasing member 100. In general, the biasing members 100 and 102 are adapted to position the central shaft 84 with respect to various positions of the piston assembly 46 where the first valve will "snap" from one locked position to another. Further, the biasing members 100 and 102 are such that these operate in conjunction with the check valves 140 and 142 so that a stall position will not occur in start up mode, regardless of the location of the piston assembly 46. A complete discussion of the operation will follow the detailed discussion of the second valve 80 given below.

Figure 5:
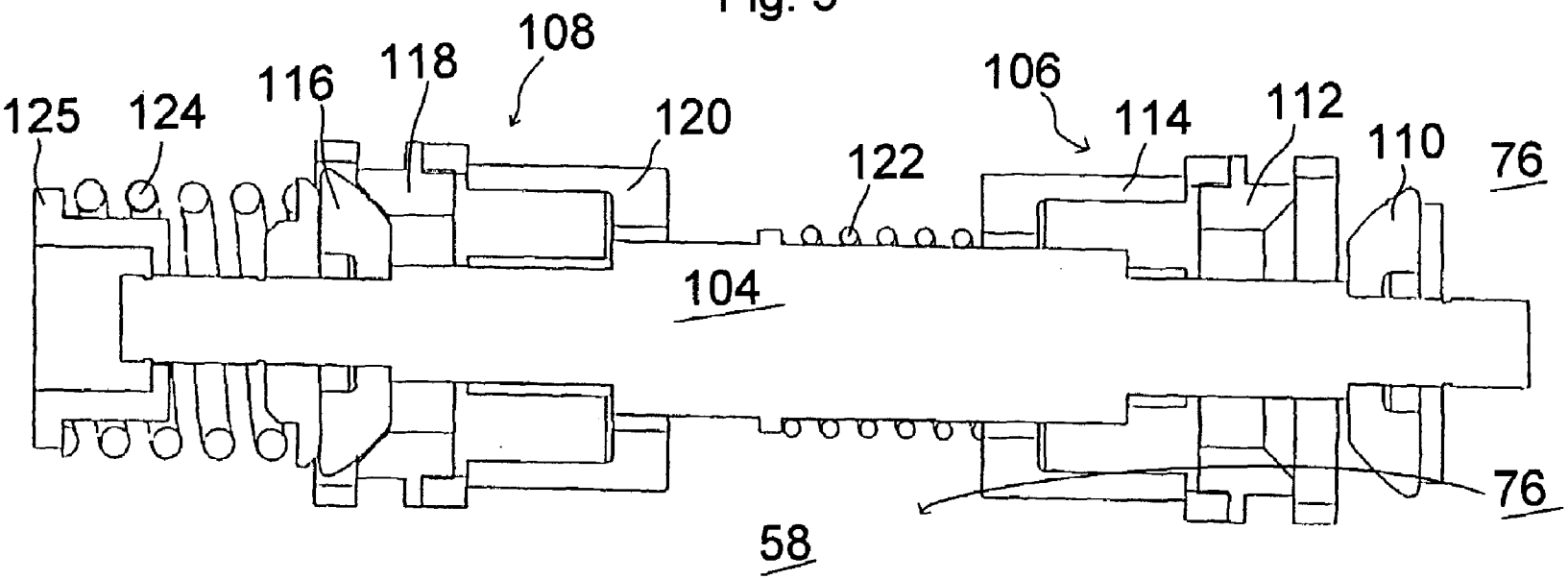
FIG. 5 shows the second valve also in the first position where the second laterally inner subchamber is in communication with the exit passage.

As shown in detail in FIG. 5, there is a valve 80 which comprises a central shaft 104, a third valve element 106, and a fourth valve element 108. The second valve 80 is somewhat similar to the first valve 78; however, the third and fourth valve elements 106 and 108 are adapted to control passage between the operating fluid of the first and second laterally inner subchamber 72 and 76 and the exit passage 58.

The second valve element comprises a third stop member 110 and a third stop seat 112. The third stop member 110 is attached to the central shaft 104 and is adapted to engage the third stop seat 112 to control the flow from the second laterally inner subchamber 76 and the exit passage 58. An encasement 114 assists in positioning the central shaft 104 and fixing the third stop seat to the valve housing 82 (see FIG. 3). Because the pressure in the second laterally inner subchamber 76 will be greater than ambient pressure at the exit passage 58, when the third valve element is in a sealing position, the third valve element 106 is in an opposite operational position (open/closed) with respect to the first valve element 86. As shown in FIG. 3, the operating fluid under intensified pressurize at pressure passage 56 will be greater than the second laterally inner subchamber 76 which will be atmospheric pressure (zero gage pressure). As seen in FIG. 4., the first valve element 86 is in a sealing position so that the slope of the first stop member 90 must be pointed conically laterally outward to react to the pressure differential between passage 56 and the chamber 76 to maintain the seal. This is also the case for the second and fourth valve elements 88 and 108 as well.

Now referring back to FIG. 5, the fourth valve element 108 comprises a fourth stop member 116 attached to the central shaft 104 and a fourth stop seat 118 effectively attached to the valve housing 82 (see FIG. 3). An encasement 120 assists in positioning the central shaft 104. The second valve 80 further has two biasing members, a third biasing member 122 and a fourth biasing member 124. The third biasing member is adapted to bias the central shaft 104 to the left in FIG. 5 so the third stop member 110 will seat against the third stop seat 112 and cut off communication between the second laterally inner subchamber 76 and the exit passage 58. The fourth biasing member 124 has one end that is attached to the central shaft 104 and the opposite end is adapted to engage the first piston member 60. In a preferred form the biasing members are springs; however, any form of delivering a force to reposition the central shafts 84 and 104 could be employed (e.g. magnetic members, leaf springs, pressure pistons, etc.).

Now referring back to FIG. 1, there will be a description of the high pressure receiving member 26. In general, the high pressure receiving member 26 requires a relatively high pressure to function effectively. As previously mentioned, a preferred use of the high pressure receiving member 26 is for a reverse osmosis seawater filter to produce substantially fresh/unsalted potable water. The high pressure receiving member 26 has two inlet ports 126 to receive the sea water and an exit port 128 to discharge the filtered water. The member 26 essentially receives operating fluid (i.e., salt water) from lines 34 and 36 and a portion of this fluid is directed to a reverse osmosis membrane (not shown) and another portion of the operating fluid (e.g. sea water) is directed to the return line 38 as high pressure.

With the foregoing foundation of elements presented there will now be a detailed discussion of the operation of this first embodiment of the present invention with attention directed to the particular features of this embodiment.

To begin the operation, the fluid enters in to the pump 23 and is pressurized to an operating pressure. The operating pressure can be in the preferred range of 10–100 psig or in some instances beyond this range. The operating fluid then passes through the pre-filter 40 that assists in removing small particulate matter. A filter that removes matter larger than 5 microns is preferred. Next, the operating fluid passes to the accumulator 42. The accumulator 42 functions as a capacitor in the fluid circuit and maintains a supply of the operating fluid which is maintained to a nearly constant pressure and which is then drawn in through either line 30 or 32.

Referring to FIG. 1, this figure schematically shows the first valve 78 providing communication with the first laterally inner subchamber 72 and the high pressure return line 38. The second valve 80 (shown schematically) is providing communication between the second laterally inner subchamber 76 and the exit passage 58 which is at atmospheric pressure. Therefore, as will become more apparent later herein, the piston assembly 46 is moving to the left in FIG. 1. The operating fluid at the operating pressure passes through a check valve 142 and enters into the second laterally outer subchamber 74. The operating fluid in the second laterally inner subchamber 76 is simultaneously venting to atmospheric pressure and is at zero gage pressure. Therefore, the cross-sectional surface area of the piston member 62 multiplied by the operating pressure results in the force value in the first longitudinal direction indicated by arrow 141. If there were a back pressure in the subchamber 76, the area of the cross-sectional surface area of the piston 62 minus the cross-sectional area of the shaft multiplied by the gage pressure in the subchamber 76, would result in a force in the second longitudinal direction indicated by arrow 143. However, the gage pressure is at zero since the exit passage 58 is in communication with the second inner subchamber 76.

The discussion of the operation will now focus on the operating fluid contained in the second laterally outer subchamber 74. As will become more apparent shortly, the piston 60 is biased to the left (the first direction) in FIG. 1 and hence the operating fluid is positively displaced through the check valve 144 to the high pressure receiving member 26. For reasons that will be described shortly, the operating fluid in line 34 is in this portion of the cycle now at the intensified pressure which is several times higher than the operating pressure produced by the pump 23. The operating fluid passes through line 34 and enters the inlet port 126 of the high pressure receiving member 26. Thereafter, it is split into two flow paths. One flow path is for a functional purpose such as a reverse osmosis filter. A second flow path is to the high pressure line 38, so that the operating fluid at the intensified pressure passes through the first valve 78 and flows into the first laterally inner subchamber 72. Now the pressure in the first laterally inner and outer subchambers 70 and 72 both are substantially at intensified pressure.

However, the cross-sectional surface area of the first laterally inner subchamber 72 is less than the first laterally outer subchamber 70 by the amount of the cross-sectional area of the shaft 64. Therefore, the net force acting on the piston assembly in the first laterally inner chamber 72 is the cross-sectional area of the shaft multiplied by the intensified pressure, and the direction of this force is in the second longitudinal direction (indicated by arrow 141 in FIG. 1). As mentioned previously, the force in the first direction (indicated by arrow 141) is created by the operating pressure of the fluid multiplied by the cross-sectional area of the first piston member 60. Although the operating pressure is several times less than the intensified pressure of the system, the operating pressure in chamber 74 is acting on a large surface area and hence biases the piston assembly 46 to the left as shown in FIG. 1.

The high pressure receiving member 26 has an internal flow resistance that creates a pressure drop between the inlet ports 126 and the exit port 128 which is presumably atmospheric, or at least at a lower pressure. Further, this flow resistance is a function of the velocity of the operating fluid that is a square of the velocity of the fluid flow.

To illustrate how the pressure of the operating fluid is intensified, let us assume that the operating pressure is 100 psig and the ratio of the area of each of the pistons 60 and 62 to the area of the shaft 64 is 15 to 1. If the membrane in the high pressure receiving chamber 26 were clogged and fluid was not permitted to exit the system and the input operating pressure was a constant 100 psig, then the static fluid circuit would produce an intensified pressure of 1500 psig (15/1*100 psig) in the subchambers 72 and 74. This intensified pressure would be necessary to keep the piston assembly from moving to the left. In other words as the pressure is building up in subchamber 74 it will initially reposition to the left in FIG. 1. As the piston assembly 46 moves to the left, the pressure in subchamber 70 will build up causing the pressure in subchamber 72 to increase at the same time. The fluid in laterally inner subchamber 72 is essentially pushing the piston assembly 46 to the left as well. Whatever the value of the pressure in the first laterally outer subchamber 70 the pressure in the second laterally outer subchamber must be, in this example, 15/1 which is 15 times the pressure to keep the pistons static (the ratio of the cross-sectional area of the piston member over the cross-sectional area of the shaft 64). It should be noted that the gage pressure in subchamber 76 is zero and hence has no effect on the force on the piston.

Now let us assume the high pressure receiving member 26 becomes unclogged and the operating fluid is permitted to pass and pass through the exit port 128. Now the piston assembly 46 will move to the left in FIG. 1 and the volume which is equal to the cross-sectional area of the shaft 64 multiplied the lateral displacement distance is equal to the output of fluid from the exit port 128. Because the pressure multiplier 24 is a positive displacement device and the operating fluid is incompressible (substantially incompressible for all practical measurable engineering purposes), the amount of operating fluid exiting the second laterally outer subchamber 74 must equal the amount of operating fluid entering the second laterally inner subchamber plus the amount exiting the high pressure receiving member 26.

As the piston assembly 46 moves to the left, the pressure in the subchambers 70 and 72 will slightly lower while the fluid accelerates through the a pressure multiplier 24. Then, as the fluid velocity increases and the internal flow resistance also increases, the piston assembly 46 will cease to accelerate and the intensified pressure in the subchambers 70 and 72 will be back to max intensified pressure and the piston will essentially be static (not accelerating) and the lateral forces acting thereon are balanced.

Now with the underlying principles of the pressure intensifying system 20 having been explained, focus will now be directed to the pressure distributor system 48.

As shown in FIG. 2 the first and second valves 78 and 80 are positioned in a manner that provides a fluid circuit flow that is schematically shown in FIG. 1. The intensified pressure from the high pressure passage 56 is in communication with the first laterally inner subchamber 72 and the second laterally inner subchamber 76 is in communication with the exit passage 58. The position of the piston assembly 46 is such that the first and second valves 78 and 80 just switched from a second position to a first position and this change was induced by the force of the first piston member 60 acting on the caps 103 and 125 (see FIGS. 4 and 5). As soon as the valves 78 and 80 are in the first position as shown in FIG. 2 the piston assembly 46 begins to move towards the first direction 141 (to the left in FIG. 2). As described above, the intensified pressure of the operating fluid in the first laterally inner subchamber 72 will create a force that substantially balances the laterally inner surface of the piston 60 against the opposing force upon the laterally outer surface of piston 60 by the pressure in the first laterally outer subchamber 70 (the lateral inner surface of piston 60 is less by the cross-sectional area of the shaft 64). The operating pressure provided by the pump 23 is fed into the second laterally outer subchamber 74, and the second laterally inner subchamber 76 is at zero gage pressure so the piston assembly 46 moves to the left as shown in FIG. 3. FIG. 4 illustrates the intensified pressure passing through the first valve element 88 into the first laterally inner subchamber 72. Further, FIG. 5 shows the operating fluid in the second laterally inner subchamber 76 passing through the third valve element 106 to the exit passage 58. The piston assembly 46 will continue to travel towards the first direction 141 (to the left in FIG. 3) until it reaches the position as shown in FIG. 6.

Figure 6:
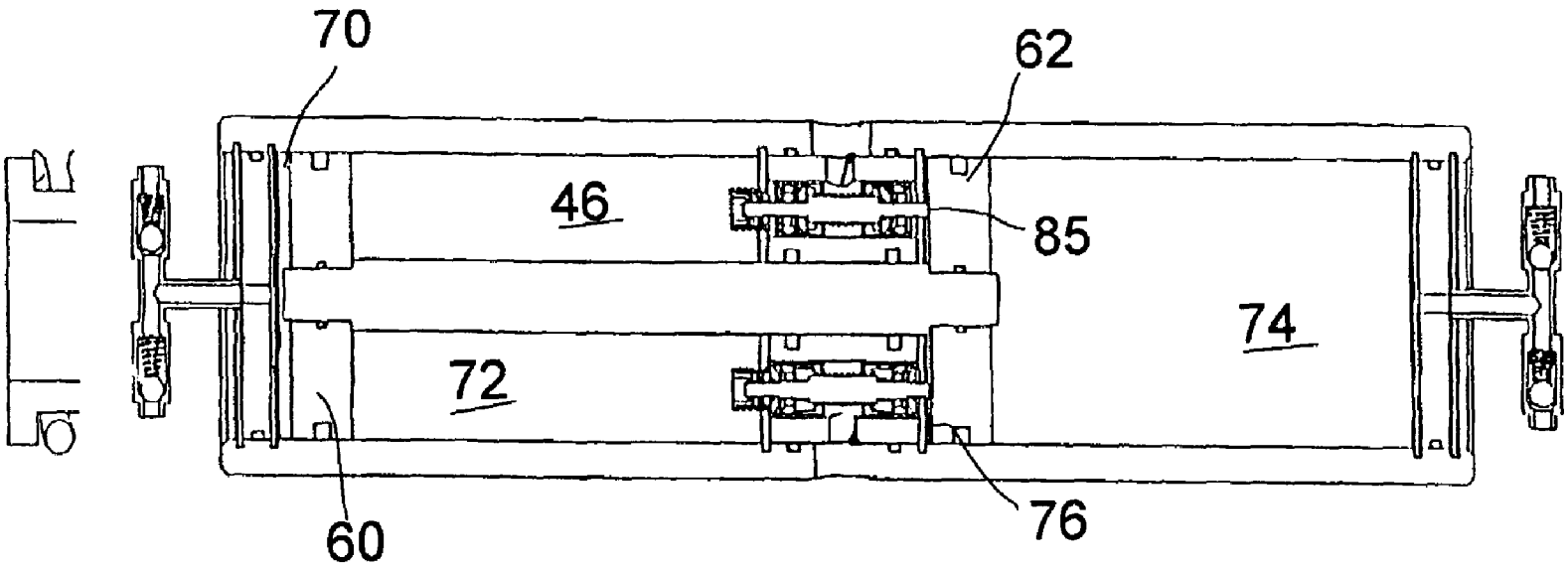
FIG. 6 shows the pressure multiplier where the piston assembly is at an extreme left location and the first and second valves are in a transition state from the first position to the second position.

FIG. 6 shows the embodiment at a dynamic state where there the valves 78 and 80 are in rapid transition. It should be noted that this transition occurs rather quickly due to the stored energy in the biasing members 100 and 122 and therefore FIG. 6 illustratively shows how the valves 78 and 80 change quickly where hydro-pressure forces acting thereon are substantially equalized.

Figure 7:
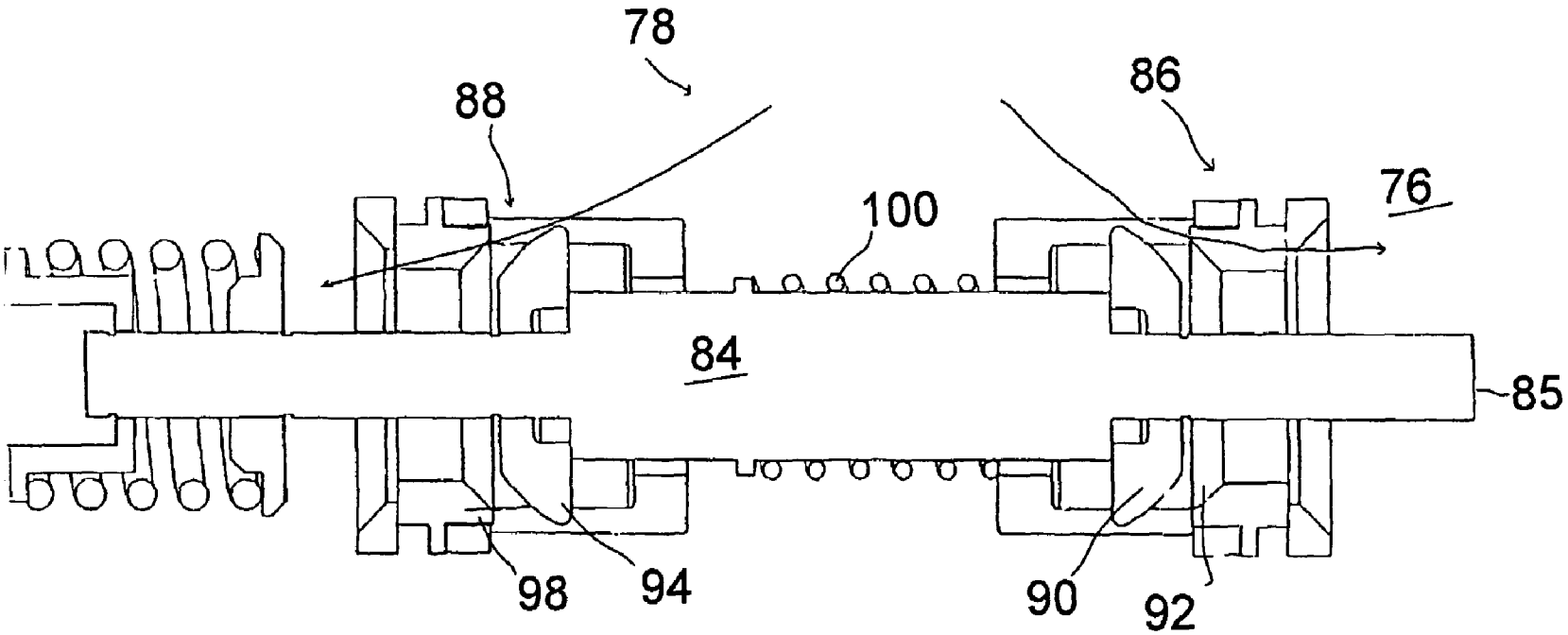
FIG. 7 shows the first valve in the dynamic state as shown in FIG. 6 where the central shaft member of the first valve is shifted to the left causing equal hydrostatic pressure upon first and second stop members whereby the first biasing member is shifting the central shaft to the left (the first direction)

The laterally inner surface of the second piston member 62 of the piston assembly 46 in FIG. 6 is in contact with the engagement surface 85 at the right end of the shaft 84 of the first valve 78. The first piston member 60 repositions the central shaft 84 towards the first direction 141 (to the left in FIG. 6). As soon as the first stop member 90 is unseated from the first stop seat 92 the operating fluid entering in through the high pressure passage 56 is allowed now to pass through not only the second valve element 88 but now also through the first valve element 86. Prior to the repositioning of the central shaft 84 the first stop member 90 was maintained in forceful engagement with the first stop seat 92 because of the pressure differential between the first laterally inner subchamber 72 and the high pressure passage 56 (see FIG. 2). Now that the seal is broken as shown in FIGS. 6 and 7, the pressures acting upon either side of the first stop member 90 (as well as the second stop member 96) are substantially equal and hence the only element that is providing a force to act upon the central shaft 84 is the first biasing member 100 which is compressed and has stored energy therein. Therefore the central shaft 84 is "snapped" to the left to a position as shown in FIGS. 9 and 10.

Figure 8:
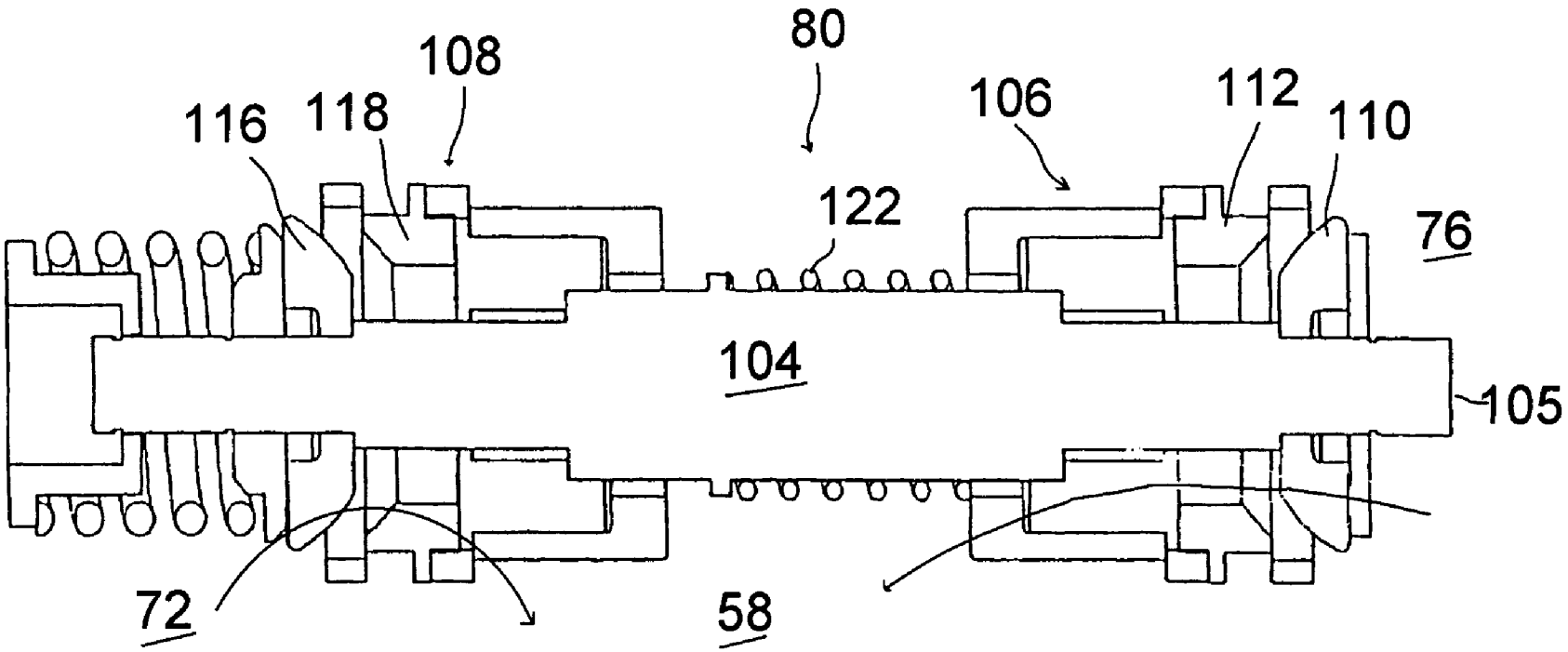
FIG. 8 shows the second valve in the dynamic state as shown in FIG. 6 where the central shaft member of the second valve is shifted to the left causing equal hydrostatic pressure upon third and fourth stop members whereby the third biasing member is shifting the central shaft to the left (the first direction)
Figure 11:
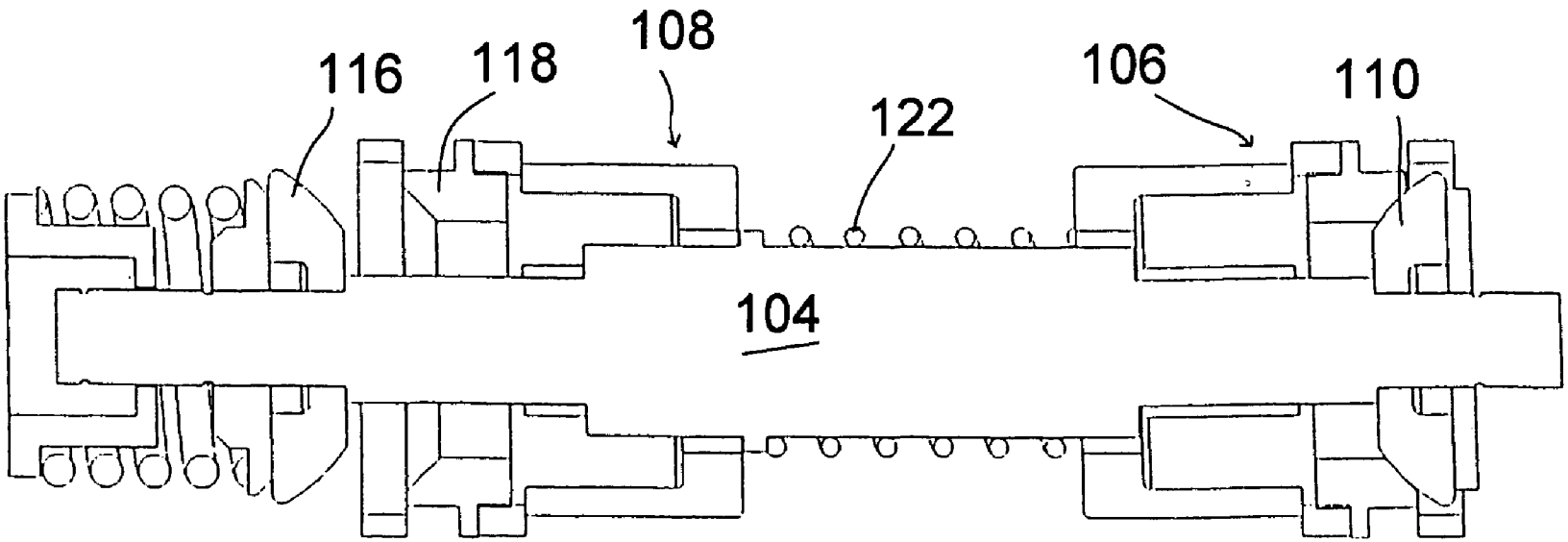
FIG. 11 is a view of the second valve in the second position as shown in FIG. 9 where the first laterally inner subchamber is in communication with the exit passage.

Now referring to FIG. 8, the second valve 80 is in a transition where the laterally inner surface of piston 62 has placed a force upon the engagement surface 105 of the central shaft 104. This moves the central shaft 104 toward the first direction (to the left in FIGS. 8 and 9) and unseats the fourth stop member 116 from the fourth stop seat 118. This allows the intensified pressure in first laterally inner subchamber 72 to leak around the fourth stop member 116 thereby now creating substantially equal pressure on either side of the fourth stop member 116. The third biasing member 122 now does not have an opposing force therefore it biases the central shaft towards the first direction and "snaps" in the second position as shown in FIGS. 9 and 11.

Figure 9:
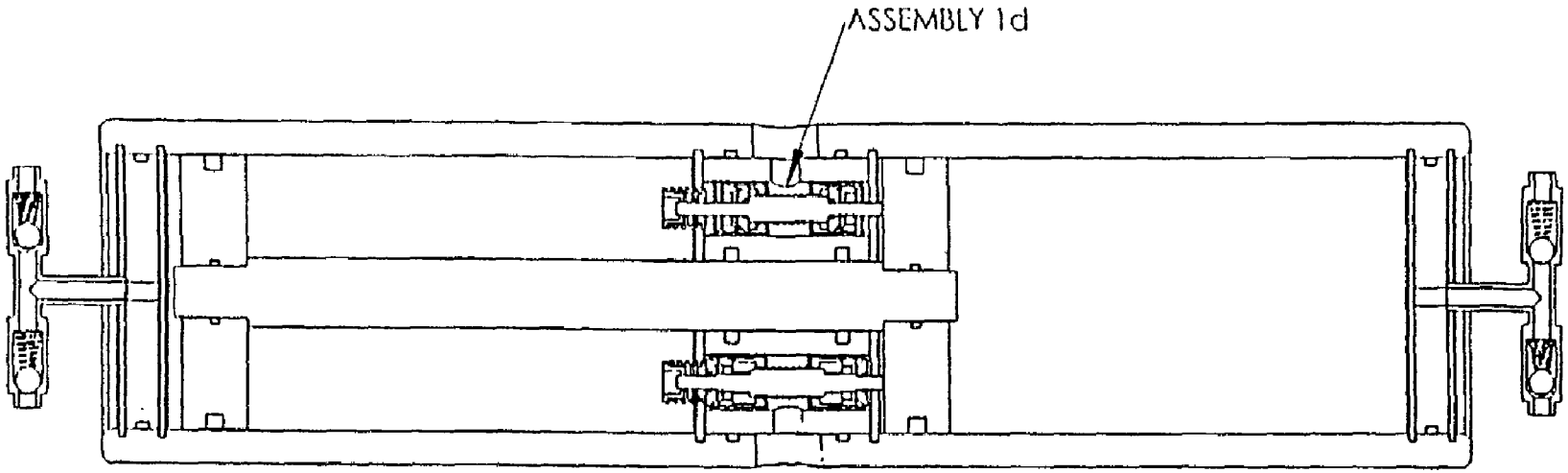
FIG. 9 shows the first and second valves in the second assembly whereby the piston assembly is moving to the right (the second direction)
Figure 10:
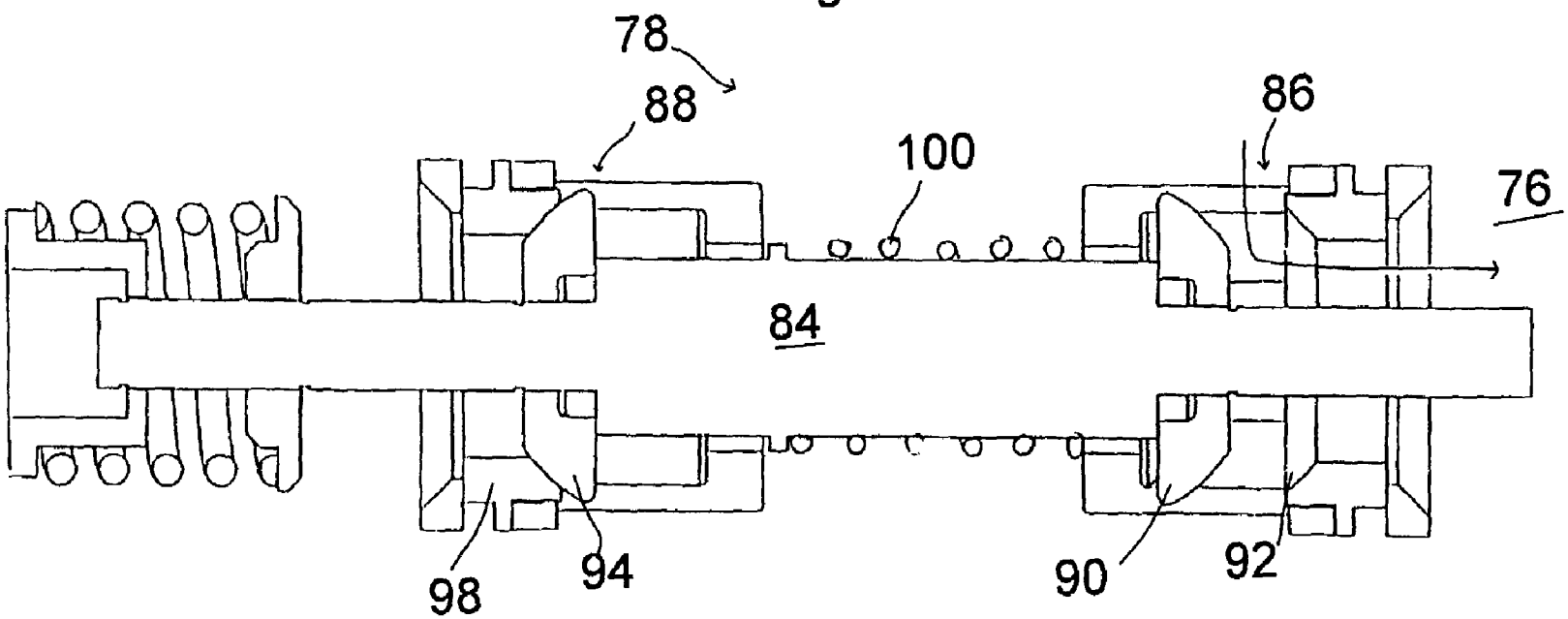
FIG. 10 shows the first valve in a the second position as shown in FIG. 9 where the operating fluid under intensified pressure is in communication with the second laterally inner subchamber.
Figure 12:
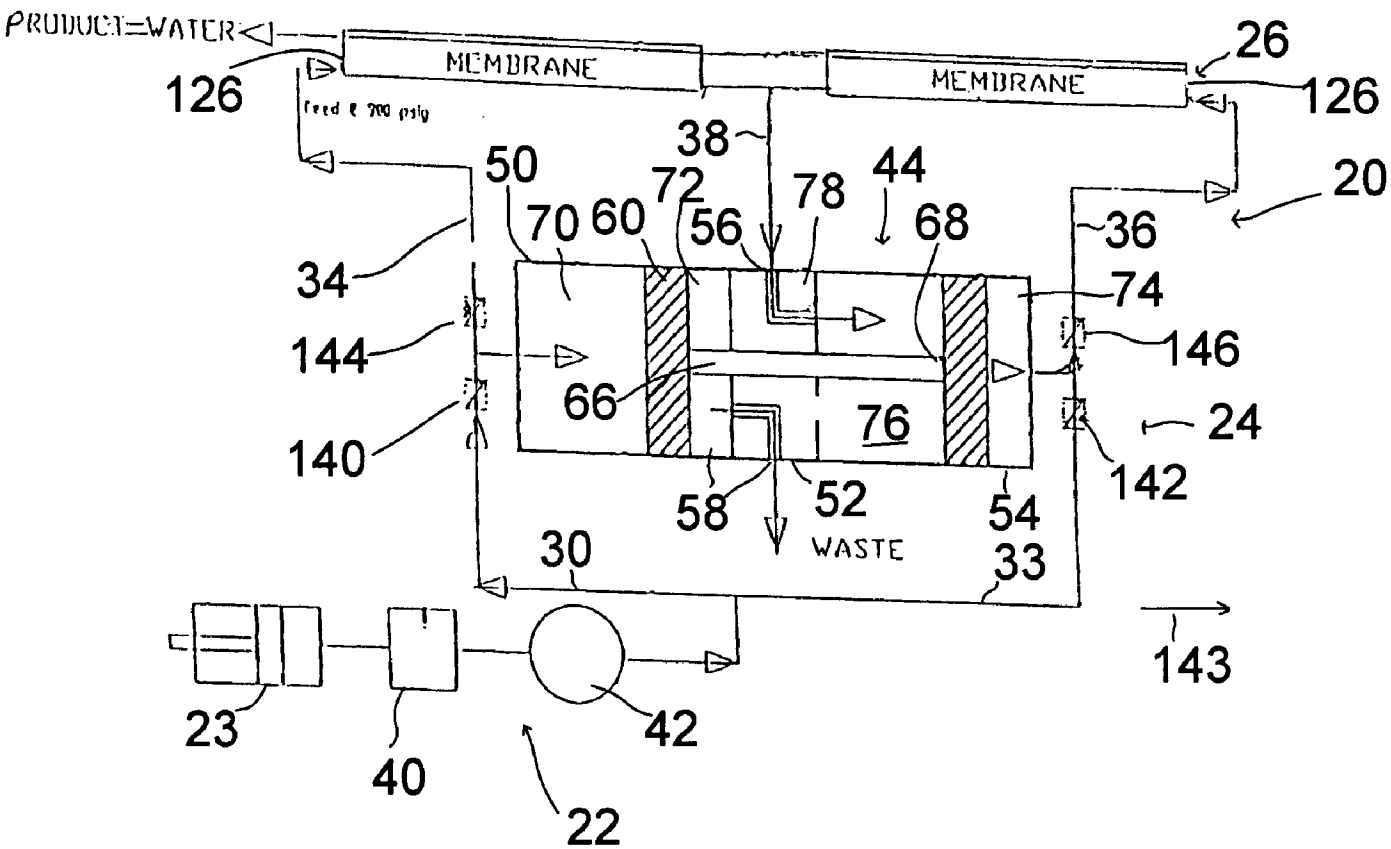
FIG. 12 schematically shows the pressure intensifier system in the second position where the returning operating fluid under intensified pressure is in communication with the second laterally inner subchamber.

FIGS. 9 and 12 show the pressure distributor system 48 in a second position where the second laterally inner subchamber 76 is in communication with the high pressure passage 56 and the first laterally inner subchamber 72 is in communication with the exit passage 58. The piston assembly 46 is now traveling towards the second direction 143 (to the right in FIG. 9) and operating fluid contained in the second laterally outer subchamber 74 is under intensified pressure. This intensified pressurized fluid now exits past the check valve 146 and the operating fluid in subchamber 72 now exits through the exit passage 58. Operating fluid at the operating pressure passes through the check valve 140 to apply a pressure-force upon the first piston member 60. It should be noted that the intensified pressure in line 34 is greater than the pressure of the line 30 by the maximum pressure multiple. Therefore line 34 is not in communication with line 30 because of the check valve 144. Likewise the intensified pressure in the second laterally outer subchamber 74 is much greater than the operating pressure in line 32. Therefore the check valve 142 prevents fluid to flow therethrough. The operation of the pressure intensifier system 20 is in the second operating position that is the opposite of the first operating position as shown in FIG. 1 (due to the pressure distributor system 48 valve orientation). The piston will continue to travel in the second direction and will reach a position as shown in FIG. 13.

Figure 13:
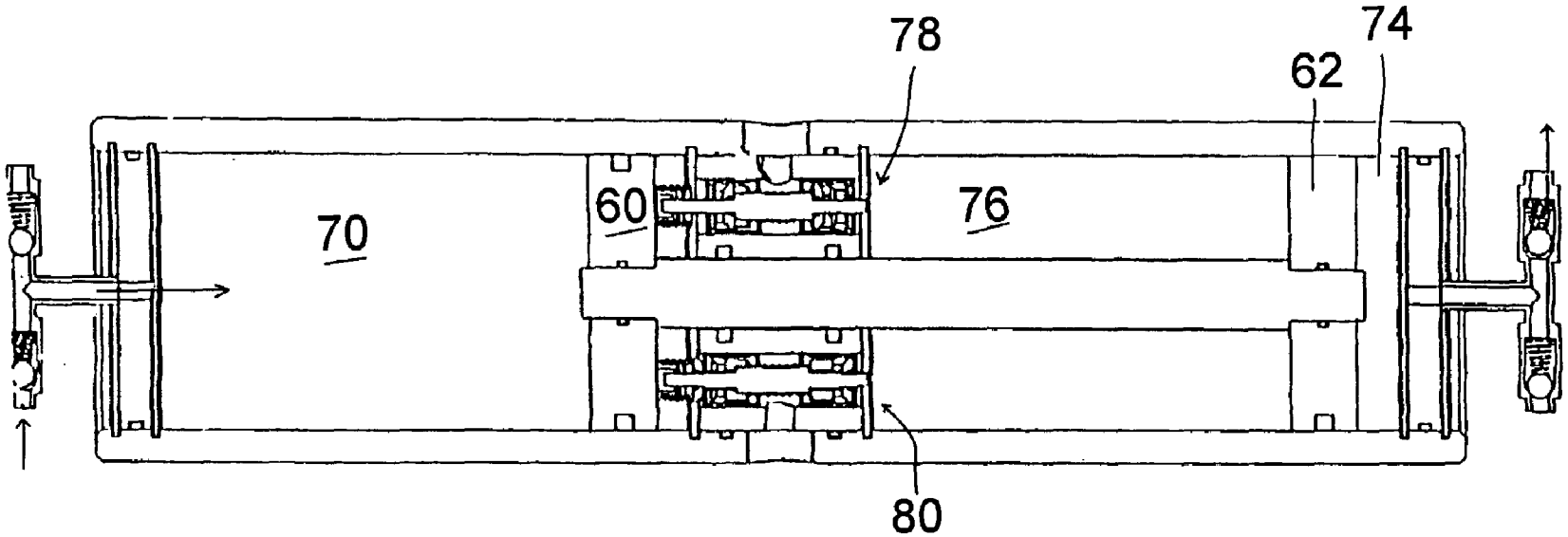
FIG. 13 shows the piston assembly to the rightward portion of the pressure cylinder where the second and fourth biasing members (springs) are partially compressed by the first piston member.
Figure 14:
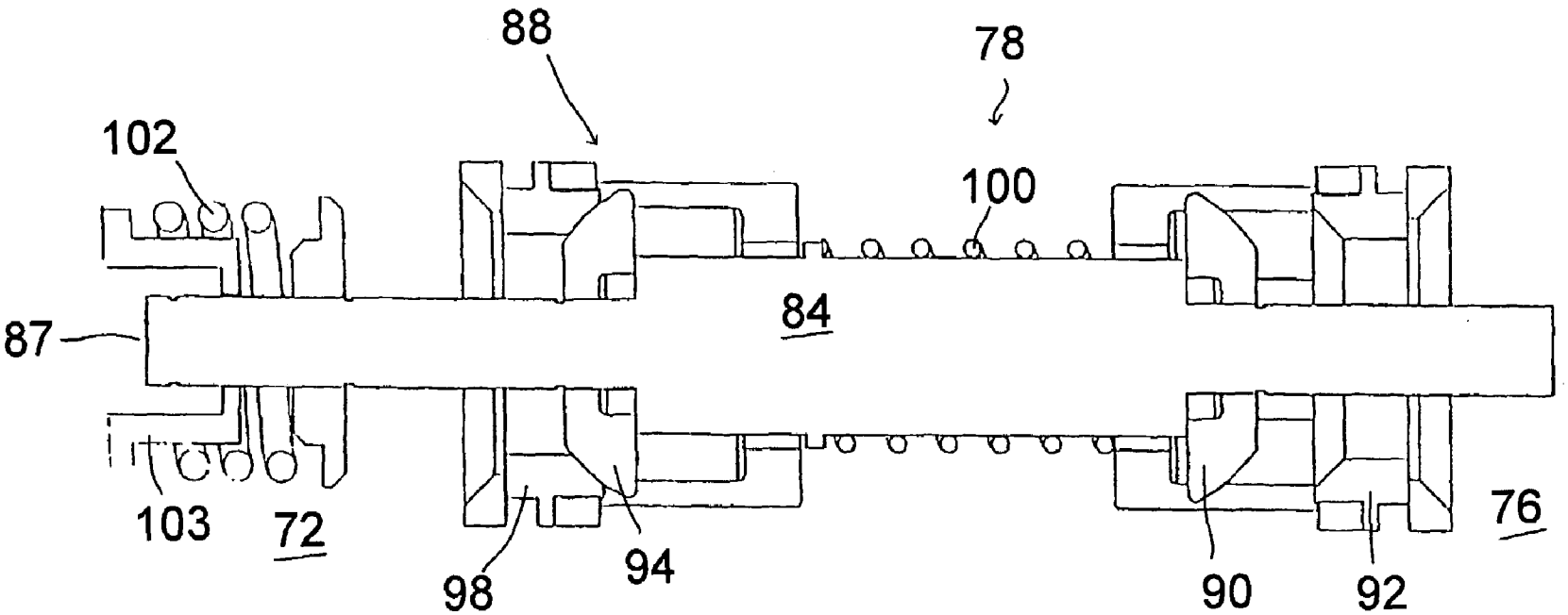
FIG. 14 shows the first valve in the position shown in FIG. 13 where the second biasing member is under partial compression and the valve remains in the second position.
Figure 15:
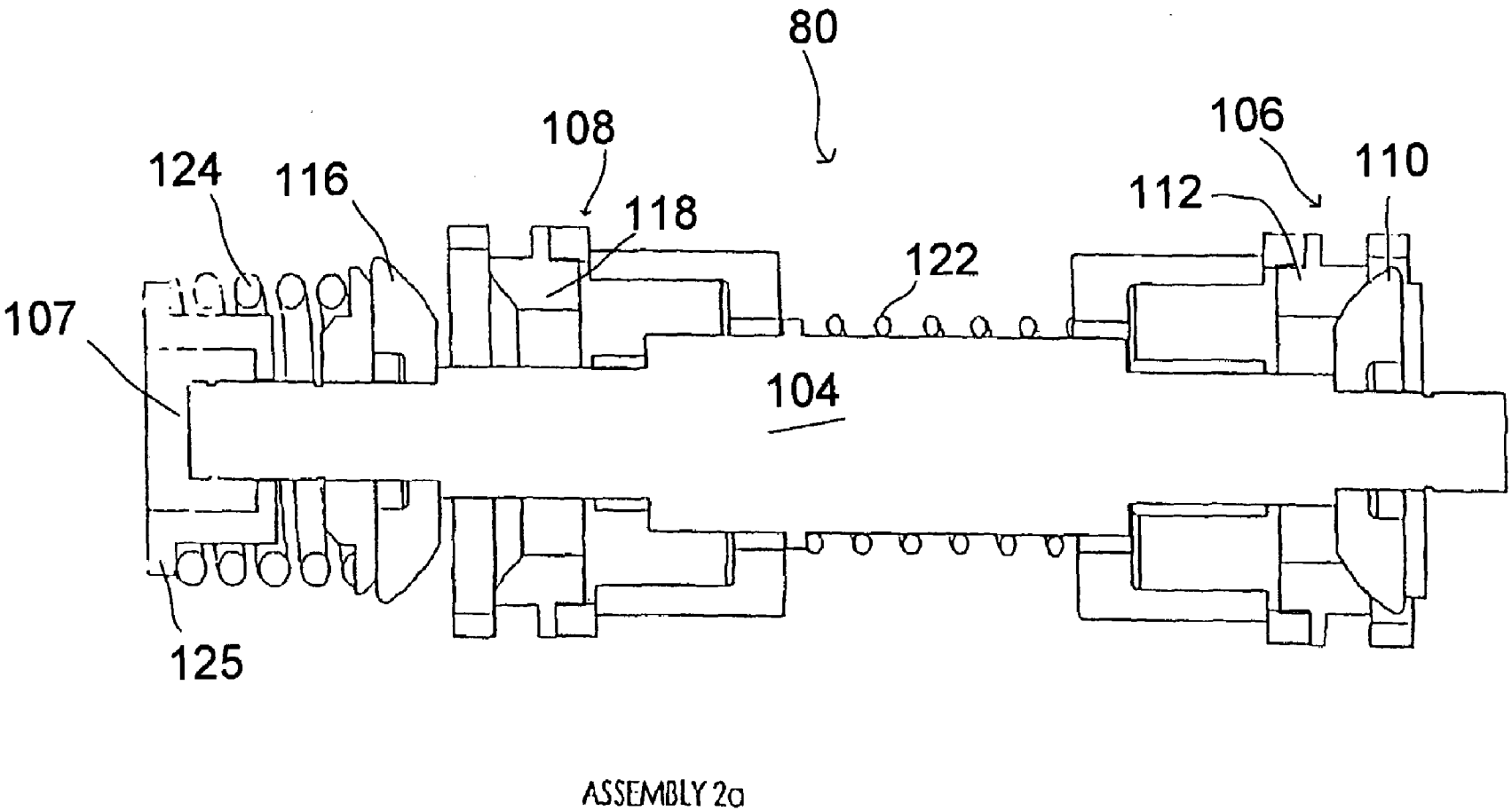
FIG. 15 shows the second valve in the position as shown in FIG. 13 where the fourth biasing member is under partial compression and still in the second position.
Figure 16:
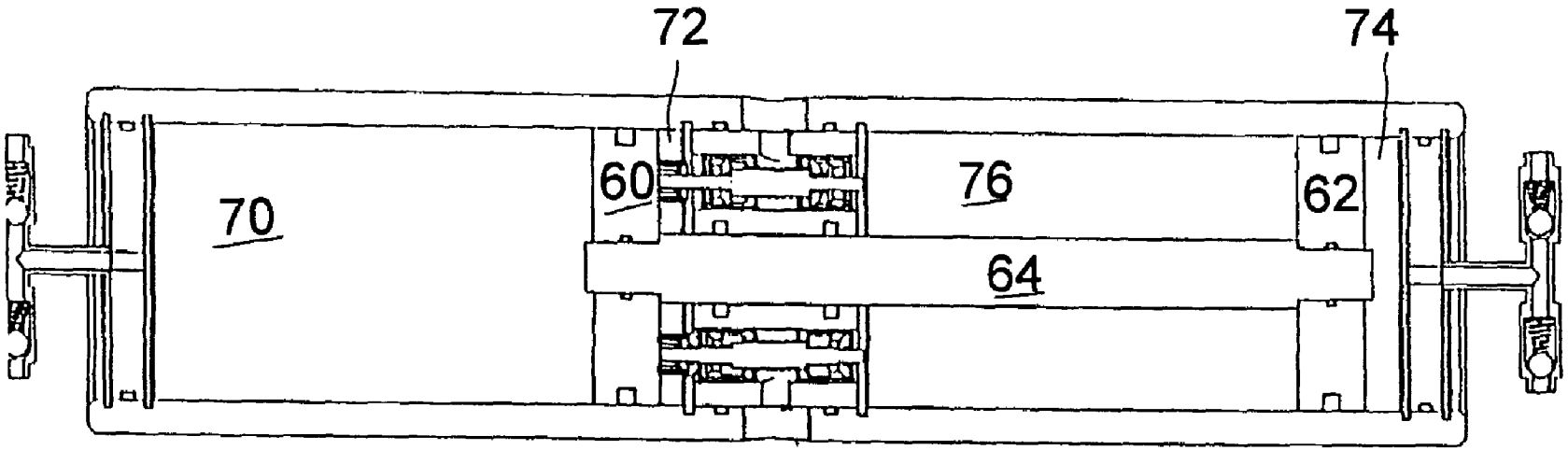
FIG. 16 shows the pressure multiplier where the first piston member is engaging the central shafts of the first and second valves and the second and third valve elements are beginning to unseat.

FIG. 13 shows the pressure distributor system 48 still in the second position; however, the first piston member 60 is traveling to the right (the second direction) and has begun compressing the second biasing member 102 and the fourth biasing member 124 (see FIGS. 14 and 15). As shown in the preferred FIGS. 13–15, force in the spring members 102 and 124 is not great enough to unseat the second valve element 88 and the third valve element 106. However, energy is being stored in the biasing members 102 and 124 as the first piston member 60 moves to the right. As the piston assembly 46 continues to move to the right to the position as shown in FIGS. 16–18, the engagement surface 87 of the central shaft 84 and the engagement surface 107 of central shaft 104 contact the first piston member 60.

Figure 17:
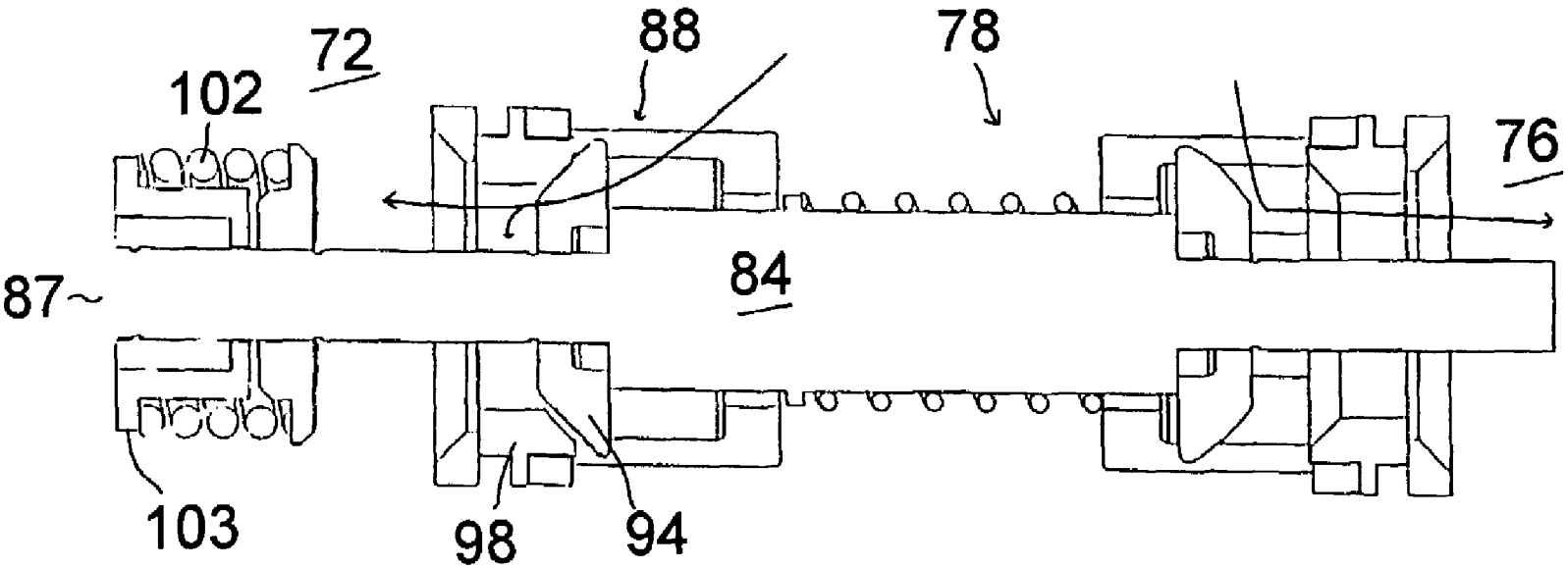
FIG. 17 shows the first valve in the position as shown in FIG. 16 where the second valve element is beginning to unseat thereby causing equal hydrostatic pressure on either side of the second stop member allowing the second biasing member to relinquish its stored energy and biasing the central shaft to the right.
Figure 18:
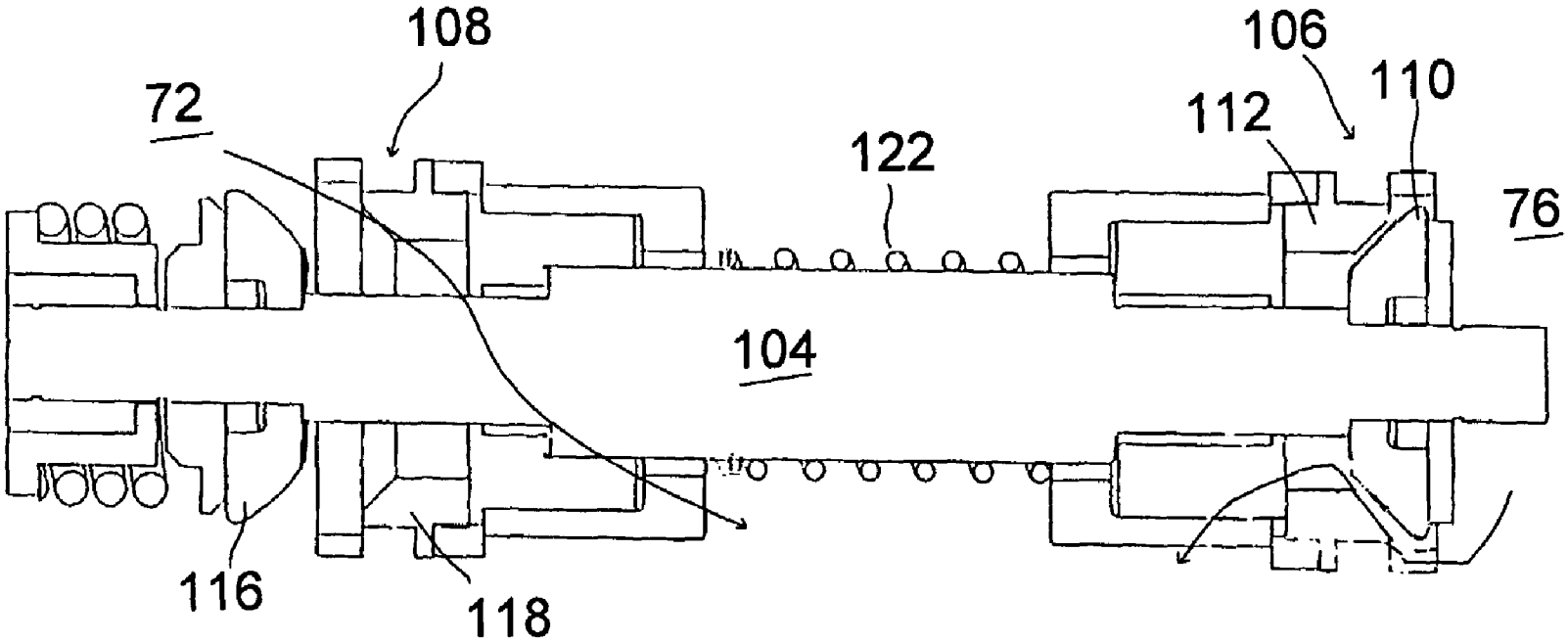
FIG. 18 shows the second valve in the position as shown in FIG. 16 where the third valve element is beginning to unseat thereby causing equal hydrostatic pressure on either side of the third stop member allowing the fourth biasing member to relinquish its stored energy and biasing the central shaft to the right.

As soon as piston member forces the central shafts 84 and 104 to be repositioned to the right, the valve elements 88 and 106 become unseated as shown in FIGS. 17 and 18. As shown in FIG. 17, the second stop member 94 has the same pressure acting on each lateral side and hence creating balanced fluid pressure-forces about the first valve 78. Now the stored energy in the second biasing member 102 comes into play and dynamically snapping the central shaft 84 and the components attached thereto to the right (second direction) to a position back where the discussion began with FIGS. 4 and 5. It should be noted that the first biasing member 100 does not produce as much force per unit of distance of travel than the second biasing member 102. Therefore when the second biasing member 102 expands the first biasing member 100 is compressed and the energy is stored there in until the first piston member 60 releases the pressure forces acting upon the first valve 78 as shown in FIG. 6.

The second valve 80 as shown in FIG. 18 performs in a similar manner to that of the first valve 78. As the central shaft 104 is repositioned to the right, the third stop member 110 is unseated from the third stop seat 112 whereby allowing the operating fluid at intensified pressure in second laterally outer subchamber 76 pass therearound. The fluid pressure is now the substantially same on both lateral sides of the third stop member 110 and the stored energy in the fourth biasing member 124 is released where by the central shaft 104 is snapped to the right (the second direction) and the second valve 80 is in the first position as shown in FIG. 5.

Referring back to FIG. 2 the pressure multiplier 24 is in what is referred to as the first position where the operating fluid in the first laterally outer subchamber 70 is now under intensified pressure and the fluid is exiting through check valve 144 and traveling to the high pressure receiving member 26.

The process will continue as long as the pressurizing system 22 supplies on operating pressure that is sufficient that when multiplied by the maximum pressure multiple to produce the intensified pressure, that value is great enough to pass through the high pressure receiving member 26.

With the foregoing in mind, there will now be a discussion regarding the operation of the pressure distributor system 48 in various non-continuous circumstances. The pressure distributor system 48 will not allow the pressure intensifier system 20 to enter a "stall" state where the fluid circuit allows a steady stream of operating fluid from the return line 38 to both of the laterally inner subchambers 72 and 76. As shown in FIGS. 7 and 8 and in FIGS. 17 and 18, the first and second valves 78 and 80 are in dynamic state of transition from a second position to a first position. The biasing members 100, 102, 122 and 124 ensure that the alternating transition from the first and second positions is dynamic and employs stored energy. The stored energy is derived from the movement of the piston assembly 46; however, the valve transition is only accomplished by the biasing members and not predicated upon the relatively slow moving piston assembly 46. In other words, once the seal between a stop member and stop seat is "cracked" and the hydrostatic pressure on either side of the seal member is equalized, the valve transition is accomplished by the stored energy in the biasing members and is independent of the position of the piston assembly.

It should be noted that the first and second valves 78 and 80 do not remain in the intermediate zone where communication between the return line 38 or the exit passage 58 and the first and second laterally inner subchambers 72 and 76.

For example, let us assume that the pump 23 stops providing pressure to the system when the second piston member is 62 is just beginning to contact the engagement surfaces 85 and 105 as shown in FIGS. 6–8. If the biasing members 100 and 122 were not present, the transition of the valves 78 and 80 are solely relied upon the force of the second piston member 62 to move the central shafts 84 and 104 to the left as shown in FIGS. 7 and 8. If this were the case, when the pump 23 shuts off, the system 20 would be in a stall state where the fluid that returns from the return line 38 would communicate with both of the inner subchambers 72 and 76. These subchambers would further be in communication with the exit passage 58. Therefore, the returning operating fluid would pass through the chambers 72 and 76 to the ambient pressure and the first inner subchamber 72 would not receive operating fluid under intensified pressure to bias the fist piston member 60 to the left in FIG. 6. Further, the flow in the return line will be diminished because the operating fluid must be under intensified pressure to pass through the reverse osmosis filter (or high pressure requiring device) of the high pressure receiving member 26. The pressure entering the high pressure receiving member 26 would only be the operating pressure produced by the pump 23.

However, the biasing members 100 and 122 do not allow the valves 78 and 80 to remain in the intermediate zone for more than an instant. Therefore, if the pump 23 were to shut off when the piston assembly 46 is in a position as shown in FIGS. 6–8, the stored energy in the biasing members 100 and 122 would continue to bias the shafts 84 and 104 to the left and place the pressure distributor system 48 in the second position. Thereafter when the pump is restarted the first and second valves 78 and 80 are in the position as shown in FIGS. 10 and 11 and the piston assembly travels to the right (the second direction). The check valve 140 has a lower crack pressure than the check valve 142 (see FIG. 1). Therefore, the fluid will initially pass through line 30 and inter the first laterally outer subchamber 70.

Now let us assume the other potential stall scenario where the piston assembly 46 is located in a position as shown in FIGS. 13–15 when the pump 23 shuts off. In this scenario the biasing members 102 and 100 in FIG. 14 could potentially have balanced opposing lateral forces. When the pressure in the entire system 20 is atmospheric, the first valve 78 could be in a where both the stops 94 and 90 are unseated from their respective stop seats 98 and 92. When the pump begins to operate and provides pressure through lines 32 and 32 (see FIG. 1), the operating fluid will first initially flow through line 30. The operating fluid would then enter the first laterally outer subchamber 70 and would bias the piston assembly to the right whereby forcing the central shafts 84 and 104 to the right until the stop members 90 and 116 engage their respective stop seats 92 and 118. Thereafter, the first laterally inner subchamber 72 is solely in communication with the high pressure passage 56 and the second laterally inner subchamber 76 is solely in communication with the exit passage 58. Therefore the piston assembly will travel to the left (the first direction) and the pressure multiplier 24 will supply intensified pressure to the high pressure receiving member 26.

It should be noted that any movement of the piston will remove the stall mode because the stored energy in the biasing members 100 and 122 will bias the pressure distributor system 48 to the second position if the piston assembly moves to the left. If this were the case than the piston assembly would immediately begin moving back to the right and begin the valve transition to the first position as shown in FIGS. 13–18 and described above. After the transition it would then again begin moving to the left.

The first and second valves 78 and 80 could be integrated in a manner so the first and third biasing members 100 and 122 are combined and the second and fourth biasing members 102 and 124 are combined where as the springing action of the combined spring providing the function of the biasing members 102 and 124 would unseat the valve elements 88 and 106. Likewise, the single spring that combines the function of the first and third biasing members 100 and 122 would be adapted to unseat the valve elements 86 and 108. Of course the present invention could take various forms without departing from the spirit and scope of the invention as presented in the proceeding claims.

A second embodiment of the present invention will now be described with reference to FIG. 19. In this second embodiment, components which are similar to components of the first embodiment will be given like numerical designations, with an "a" suffix, distinguishing those of the second embodiment. The following components that appear both in the first embodiment and also in the second embodiment, are for ease of illustration not shown in FIG. 19. These components that are not shown are the pressurizing system 22, the pressure cylinder 44, the piston assembly 46, the fluid distributor system 35, and the high pressure receiving member 26, with the understanding that these components or "equivalent components" are also part of the second embodiment. The components of the second embodiment which may differ from those of the first embodiment are primarily in the pressure distribution system 48*a* of the second embodiment. In the second embodiment, there are the high pressure passage 56*a* through which the intensified return fluid passes, and also the exit passage 58*a* where the low pressure fluid is discharge is also in the second embodiment. The main differences in the second embodiment relative to the first embodiment are in the two valves 78*a* and 80*a*.

The valve 78*a* comprises a spool valve member 150*a* which is positioned for back and forth motion in an adjacent first valve housing 152*a*. The spool valve member 150*a* has a central cylindrical spool portion 154*a* with right and left circumferential grooves 156*a* and 158*a* adjacent thereto. Extending oppositely from the location of the grooves 156*a* and 158*a*, are right and left cylindrical connecting sections 160*a* and 162*a* which connect, respectively, to retaining end members 164*a* and 166*a*.

The two connecting members 160*a* and 162*a* have a center longitudinally aligned passageway, 168*a* and 170*a*, respectively, opening to opposite ends of the valve member 150*a*. The inner ends of these passageways 168*a* and 170*a* connect to radially aligned through openings 172*a* and 174*a*, respectively, which in turn extend through the grooves 156*a* and 158*a*.

Figure 19:
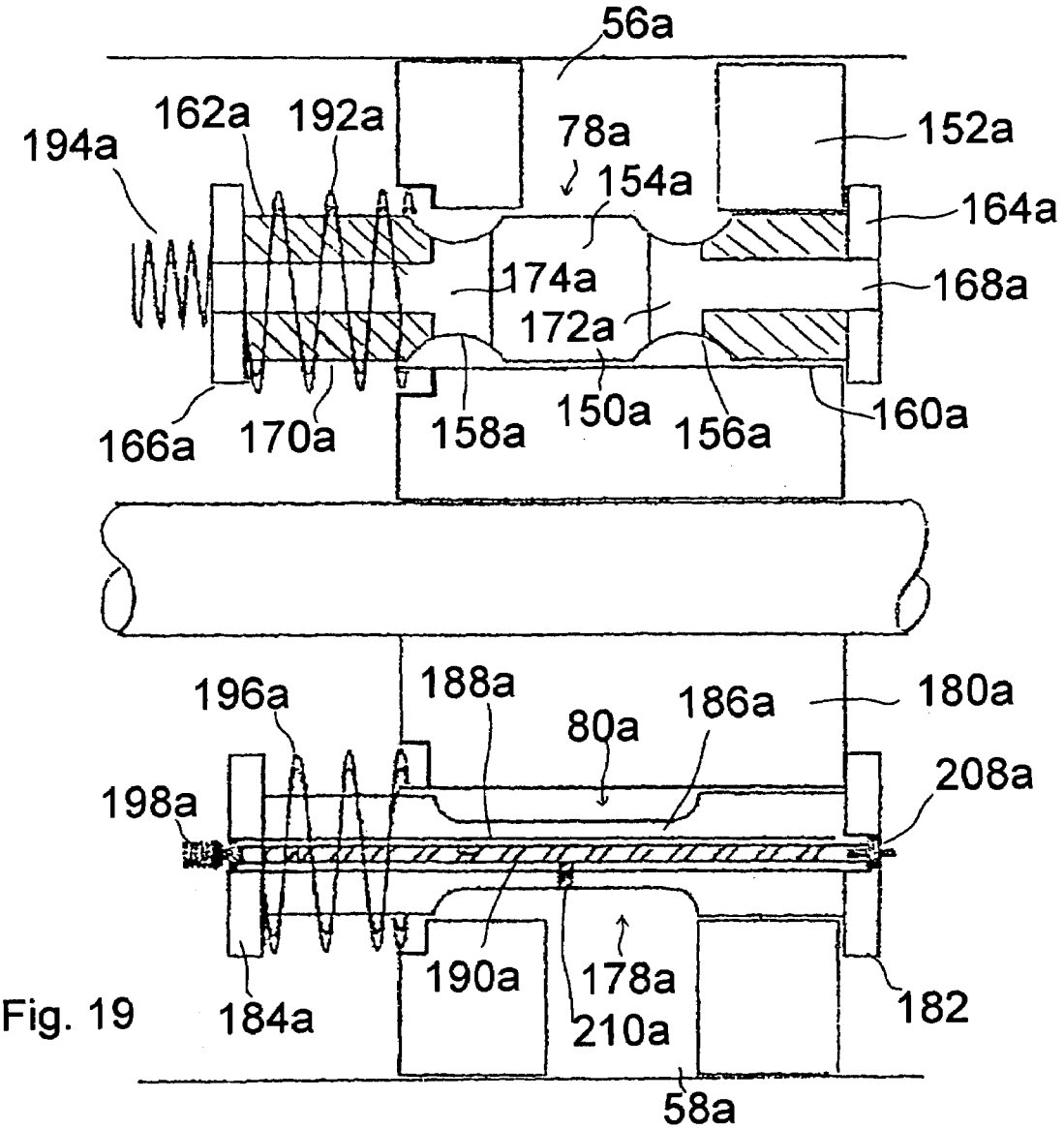
FIG. 19 is a view of the pressure distributor system of a second embodiment of the present invention.

Thus, it can be seen that in the position of FIG. 19 that the valve member 150*a* is positioned so that the flow downwardly from the passageway 56*a* flows through the passageways 172*a* and 168*a* into the adjacent subchamber 76*a*. The left portion of the central cylindrical spool 154*a* blocks the passageway to the left, since the circular groove 158*a* is not in connection with the high pressure inlet passageway 56*a*.

Figure 20:
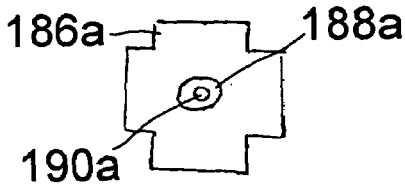
FIG. 20 is a sectional view taken along line 20—20 of FIG. 19.

The valve 80*a* is also shown in FIG. 19. This valve 80*a* comprises a valve element 178*a* which is mounted for back and forth movement in a related valve housing 180*a*. The valve element 168*a* has right and left end seal plates 182*a* and 184*a*. These seal plates 182*a* and 184*a* may have a circular configuration and are connected by a single connecting member 186*a* that has at outer end portions a cross sectional configuration similar to that shown in FIG. 20. Thus, it can be seen that with the valve element 178*a* in the position of FIG. 19, the fluid in the adjacent laterally inner subchamber 72*a* to the left is passing around the connecting portion 186*a* of the valve element 168*a*, and out the exit opening 58*a*.

The longitudinally connecting member 186*a* of the valve element 168*a* has an elongate longitudinal, cylindrically shaped center opening 188*a* in which is positioned a rod 190*a* that has a diameter moderately less than the central opening 178*a*.

With regard to the valve element 178*a*, it will be noted that there are two springs 192*a* and 194*a*, and these function in generally the same manner as the corresponding biasing springs in the first embodiment. Accordingly, there will not be detailed explanation of their operation in this text describing this second embodiment.

There is also a biasing spring 196*a* which is positioned on the left-hand side of the connecting member 186*a* that urges the valve element 178*a* to the left, and this functions in substantially the same way as the corresponding biasing spring described in the first embodiment.

Figure 21:
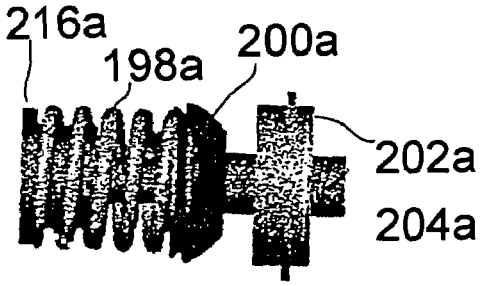
FIG. 21 is a drawing made to an enlarged scale showing that portion of FIG. 19 which is in a broken line circle designated "21".

In addition, there is a spring 198*a* (see FIGS. 19 and 21) which is connected to a frusto-conical closure member 200*a* that is adjacent to the left end opening of the center passageway 188*a*. Also, there is a retaining member 202*a* which connects through a small shaft 204*a* to the seal member 200*a*. A circumferential flange 206*a* retains the spring 198*a* onto the shaft 204*a*. It can be seen that when the end flange 206*a* is engaged by the left piston, this will compress the spring 198*a* and cause the sealing member 208 to close the left end of the passageway 188*a*. At the same time, this will function to open another sealing member 208*a* that is at the opposite end of the rod 190*a*. There is a port 210*a* which is drilled through the center portion of the connecting member 186*a* to connect to the exit passageway 58*a*. Thus, this will cause the right inner subchamber to be vented to atmospheric pressure. This venting function would be of benefit in a situation where there may be a pressure lock in one or the other of the inner subchambers that would impede movement of the valve element 80*a*.

It is believed that the functioning of this second embodiment is apparent from the earlier description of the functioning of the first embodiment. With the two valves 78*a* and 80*a* in the positions shown in FIGS. 19 and 20, respectively, it is evident that the piston assembly is moving from left to right, and when the piston on the left of the two valves 78*a* and 80*a* comes into contact with the left end of the valve elements 150*a* and 168*a*, the two valve elements 150*a* and 168*a* will be moved to the opposite positions so that the piston assembly will reverse its path of travel.

I claim:

1. A pressure intensifier system adapted to increase the pressure of an operating fluid, the pressure intensifier comprising, a) a pressure cylinder having a first region, a central region and a second region where the lateral direction from the central region to the first region indicates a first direction and an opposing lateral direction from the central region to the second region indicates a second direction, the pressure cylinder having an interior surface, a high pressure passage, and an exit passage;

b) a piston assembly comprising, a first piston member positioned in the first region of the pressure cylinder, the first piston member in sealing engagement with the inner surface of the pressure cylinder thereby defining a first laterally outer subchamber and a first laterally inner subchamber;

a second piston member positioned in the second region of the pressure cylinder, the second piston member in sealing engagement with the inner surface of the pressure cylinder thereby defining a second laterally outer subchamber and a second laterally inner subchamber, a connecting member having first and second lateral ends that are fixedly connected to the first and second piston members respectively;

c) a pressure distributor system positioned in the pressure cylinder comprising, a first valve located in the central region of the pressure cylinder and allowing communication between the high pressure passage and either the first laterally inner subchamber or the second laterally inner subchamber, the first valve having a first biasing member that biases the first valve to a second position of the first valve that provides communication between the second laterally inner subchamber and the high pressure passage, a second biasing member adapted to change the first valve to a first position of the first valve that provides communication between the first laterally inner subchamber and the high pressure passage;

a second valve located in the central region of the pressure cylinder and allowing communication between the exit passage and either the first laterally inner subchamber or the second laterally inner subchamber, the second valve having a third biasing member that biases the second valve to a first position of the second valve that provides communication between the second laterally inner subchamber and the exit passage, a fourth biasing member adapted to change the second valve to a second position of the second valve that provides communication between the first laterally inner subchamber and the exit passage;

d) a pressurizing system having a first line portion that is in communication with the first laterally outer subchamber and the second laterally outer subchamber where a check valve system allows unidirectional flow to the first or second laterally outer subchambers;

a high pressure receiving member having a high pressure inlet port connected to the first and second laterally outer subchambers and a check valve system allows unidirectional flow to the inlet port, a return line that provides communication between the high pressure inlet port and the high pressure passage of the pressure cylinder; the high pressure receiving member having a high pressure operating device in communication with the high pressure inlet port;

whereby the piston assembly is adapted to oscillate to alternately displace operating fluid contained therein the first laterally outer subchamber and the second laterally outer subchamber to deliver the operating fluid under intensified pressure to the high pressure receiving member whereby a portion of this fluid is directed to the high pressure passage of the pressure cylinder;

e) the second biasing member positioning the first valve at the first position of the first valve by employing stored energy of the second biasing member; and f) the second biasing member having a higher spring constant than the first biasing member whereby when the second biasing member positions the first valve to the first position of the first valve, the first biasing member stores potential energy therein.

2. The pressure intensifier system as recited in claim 1 where the first valve is adapted to remain in the first position of the first valve while the operating fluid is under intensified pressure in the high pressure passage and the second laterally inner subchamber is at a respective lower pressure.

3. The pressure intensifier system as recited in claim 2 where the first valve is adapted to change to the second position of the first valve when the motion of the piston assembly in the first direction unseats the first valve element thereby unlocking the potential energy stored in the first biasing member seating the second valve element.

4. A pressure intensifier system adapted to increase the pressure of an operating fluid, the pressure intensifier comprising, a) a pressure cylinder having a first region, a central region and a second region where the lateral direction from the central region to the first region indicates a first direction and an opposing lateral direction from the central region to the second region indicates a second direction, the pressure cylinder having an interior surface, a high pressure passage, and an exit passage;

b) a piston assembly comprising, a first piston member positioned in the first region of the pressure cylinder, the first piston member in sealing engagement with the inner surface of the pressure cylinder thereby defining a first laterally outer subchamber and a first laterally inner subchamber;

a second piston member positioned in the second region of the pressure cylinder, the second piston member in sealing engagement with the inner surface of the pressure cylinder thereby defining a second laterally outer subchamber and a second laterally inner subchamber, a connecting member having first and second lateral ends that are fixedly connected to the first and second piston members respectively;

c) a pressure distributor system positioned in the pressure cylinder comprising, a first valve located in the central region of the pressure cylinder and allowing communication between the high pressure passage and either the first laterally inner subchamber or the second laterally inner subchamber, the first valve having a first biasing member that biases the first valve to a second position of the first valve that provides communication between the second laterally inner subchamber and the high pressure passage, a second biasing member adapted to change the first valve to a first position of the first valve that provides communication between the first laterally inner subchamber and the high pressure passage;

a second valve located in the central region of the pressure cylinder and allowing communication between the exit passage and either the first laterally inner subchamber or the second laterally inner subchamber, the second valve having a third biasing member that biases the second valve to a first position of the second valve that provides communication between the second laterally inner subchamber and the exit passage, a fourth biasing member adapted to change the second valve to a second position of the second valve that provides communication between the first laterally inner subchamber and the exit passage;

d) a pressurizing system having a first line portion that is in communication with the first laterally outer subchamber and the second laterally outer subchamber where a check valve system allows unidirectional flow to the first or second laterally outer subchambers;

a high pressure receiving member having a high pressure inlet port connected to the first and second laterally outer subchambers and a check valve system allows unidirectional flow to the inlet port, a return line that provides communication between the high pressure inlet port and the high pressure passage of the pressure cylinder; the high pressure receiving member having a high pressure operating device in communication with the high pressure inlet port;

whereby the piston assembly is adapted to oscillate to alternately displace operating fluid contained therein the first laterally outer subchamber and the second laterally outer subchamber to deliver the operating fluid under intensified pressure to the high pressure receiving member whereby a portion of this fluid is directed to the high pressure passage of the pressure cylinder;

e) the fourth biasing member positioning the second valve to the first position of the second valve by employing stored energy of the fourth biasing member;

f) the fourth biasing member having a higher spring constant than the third biasing member whereby when the fourth biasing member positions the second valve to the first position of the second valve, the third biasing member stores potential energy therein.

5. The pressure intensifier system as recited in claim 4 where the second valve is adapted to remain in the first position of the second valve while operating fluid in the first laterally inner subchamber is under intensified pressure and the exit passage is at a respective lower pressure.

6. The pressure intensifier system as recited in claim 5 where the second valve is adapted to change to the second position of the second valve when the motion of the piston assembly in the first direction unseats the fourth valve element whereby unlocking the potential energy stored in the third biasing member thereby seating the second valve element.

7. A pressure intensifier system adapted to increase the pressure of an operating fluid, the pressure intensifier comprising, a) a pressure cylinder having a first region, a central region and a second region where the lateral direction from the central region to the first region indicates a first direction and an opposing lateral direction from the central region to the second region indicates a second direction, the pressure cylinder having an interior surface, a high pressure passage, and an exit passage;

b) a piston assembly comprising, a first piston member positioned in the first region of the pressure cylinder, the first piston member in sealing engagement with the inner surface of the pressure cylinder thereby defining a first laterally outer subchamber and a first laterally inner subchamber;

a second piston member positioned in the second region of the pressure cylinder, the second piston member in sealing engagement with the inner surface of the pressure cylinder thereby defining a second laterally outer subchamber and a second laterally inner subchamber, a connecting member having first and second lateral ends that are fixedly connected to the first and second piston members respectively;

c) a pressure distributor system positioned in the pressure cylinder comprising, a first valve located in the central region of the pressure cylinder and allowing communication between the high pressure passage and either the first laterally inner subchamber or the second laterally inner subchamber, the first valve having a first biasing member that biases the first valve to a second position of the first valve that provides communication between the second laterally inner subchamber and the high pressure passage, a second biasing member adapted to change the first valve to a first position of the first valve that provides communication between the first laterally inner subchamber and the high pressure passage;

a second valve located in the central region of the pressure cylinder and allowing communication between the exit passage and either the first laterally inner subchamber or the second laterally inner subchamber, the second valve having a third biasing member that biases the second valve to a first position of the second valve that provides communication between the second laterally inner subchamber and the exit passage, a fourth biasing member adapted to change the second valve to a second position of the second valve that provides communication between the first laterally inner subchamber and the exit passage;

d) a pressurizing system having a first line portion that is in communication with the first laterally outer subchamber and the second laterally outer subchamber where a check valve system allows unidirectional flow to the first or second laterally outer subchambers;

a high pressure receiving member having a high pressure inlet port connected to the first and second laterally outer subchambers and a check valve system allows unidirectional flow to the inlet port, a return line that provides communication between the high pressure inlet port and the high pressure passage of the pressure cylinder; the high pressure receiving member having a high pressure operating device in communication with the high pressure inlet port;

whereby the piston assembly is adapted to oscillate to alternately displace operating fluid contained therein the first laterally outer subchamber and the second laterally outer subchamber to deliver the operating fluid under intensified pressure to the high pressure receiving member whereby a portion of this fluid is directed to the high pressure passage of the pressure cylinder; and e) the first piston being adapted to engage the second biasing member thereby storing potential energy therein as the piston assembly travels in the second direction and when the second stop member is unseated from the second stop seat, the hydrostatic forces on the second stop member are equalized on either side thereof, and the stored energy of the second biasing member biases the central shaft in the second direction thereby seating the first stop member in sealing engagement with the first stop seat.

8. A pressure intensifier system adapted to increase the pressure of an operating fluid, the pressure intensifier comprising, a) a pressure cylinder having a first region, a central region and a second region where the lateral direction from the central region to the first region indicates a first direction and an opposing lateral direction from the central region to the second region indicates a second direction, the pressure cylinder having an interior surface, a high pressure passage, and an exit passage;

b) a piston assembly comprising, a first piston member positioned in the first region of the pressure cylinder, the first piston member in sealing engagement with the inner surface of the pressure cylinder thereby defining a first laterally outer subchamber and a first laterally inner subchamber;

a second piston member positioned in the second region of the pressure cylinder, the second piston member in sealing engagement with the inner surface of the pressure cylinder thereby defining a second laterally outer subchamber and a second laterally inner subchamber, a connecting member having first and second lateral ends that are fixedly connected to the first and second piston members respectively;

c) a pressure distributor system positioned in the pressure cylinder comprising, a first valve located in the central region of the pressure cylinder and allowing communication between the high pressure passage and either the first laterally inner subchamber or the second laterally inner subchamber, the first valve having a first biasing member that biases the first valve to a second position of the first valve that provides communication between the second laterally inner subchamber and the high pressure passage, a second biasing member adapted to change the first valve to a first position of the first valve that provides communication between the first laterally inner subchamber and the high pressure passage;

a second valve located in the central region of the pressure cylinder and allowing communication between the exit passage and either the first laterally inner subchamber or the second laterally inner subchamber, the second valve having a third biasing member that biases the second valve to a first position of the second valve that provides communication between the second laterally inner subchamber and the exit passage, a fourth biasing member adapted to change the second valve to a second position of the second valve that provides communication between the first laterally inner subchamber and the exit passage;

d) a pressurizing system having a first line portion that is in communication with the first laterally outer subchamber and the second laterally outer subchamber where a check valve system allows unidirectional flow to the first or second laterally outer subchambers;

a high pressure receiving member having a high pressure inlet port connected to the first and second laterally outer subchambers and a check valve system allows unidirectional flow to the inlet port, a return line that provides communication between the high pressure inlet port and the high pressure passage of the pressure cylinder; the high pressure receiving member having a high pressure operating device in communication with the high pressure inlet port;

whereby the piston assembly is adapted to oscillate to alternately displace operating fluid contained therein the first laterally outer subchamber and the second laterally outer subchamber to deliver the operating fluid under intensified pressure to the high pressure receiving member whereby a portion of this fluid is directed to the high pressure passage of the pressure cylinder;

e) the second valve comprising a central shaft of the second valve, a third valve element comprising a third stop member attached to the central shaft of the second valve and a third stop seat, and a fourth valve element comprising a fourth stop member attached to the central shaft of the second valve and a fourth stop seat in a manner that the third valve element controls communication between the second laterally inner subchamber and the exit passage and the fourth valve element controls communication between the first laterally inner subchamber and the exit passage whereby the third biasing member biases the central shaft toward the first direction and the fourth biasing member biases the central shaft in the second direction; and f) the first piston being adapted to engage the fourth biasing member thereby storing potential energy therein as the piston assembly travels in the second direction and when the third stop member is unseated from the third stop seat the hydrostatic forces on the third stop member are equalized on either side thereon and the stored energy of the fourth biasing member biases the central shaft of the second valve in the second direction thereby seating the first stop member in sealing engagement with the first stop seat.

* * * * *